US005799226A

United States Patent [19]

Shigeta et al.

[11] Patent Number: 5,799,226

[45] Date of Patent: Aug. 25, 1998

[54] ELECTROSTATIC IMAGE FORMING APPARATUS WITH TRANSFER CONTROLS FOR DIFFERENT IMAGING MODES

[75] Inventors: Kunio Shigeta; Yotaro Sato; Satoshi Haneda, all of Hachioji, Japan

[73] Assignee: Konica Corporation, Japan

[21] Appl. No.: 876,745

[22] Filed: Jun. 16, 1997

[30] Foreign Application Priority Data

Jun. 21, 1996 [JP] Japan ..... 8-161641
Apr. 11, 1997 [JP] Japan ..... 9-093842

[51] Int. Cl.[6] ..... G03G 15/16

[52] U.S. Cl. ..... 399/66; 399/309

[58] Field of Search ..... 399/66, 82, 364, 399/297, 306, 308, 309

[56] References Cited

U.S. PATENT DOCUMENTS 3,580,670 5/1971 Bhagat ..... 399/306
4,427,285 1/1984 Stange ..... 399/306

*Primary Examiner*—S. Lee
*Attorney, Agent, or Firm*—Jordan B. Bierman; Bierman, Muserlian and Lucas

[57] ABSTRACT

An image forming apparatus includes: a toner image forming device to form a toner image on a first image carrier; a first transfer device to transfer the toner image on the first image carrier onto a second image carrier provided opposite to the first image carrier to carry a transferred toner image, or to transfer the toner image on the first image carrier onto one side of a transfer material; a second transfer device to transfer the toner image carried on the second image carrier onto the other side of the material; a fixing device to fix at least one of the toner image on the one side of the transfer material and the toner image on the other side of the transfer material; and a control device to control the toner image forming device, the first transfer device and the second transfer device. The control device has a first image forming mode in which image formation is conducted only on said one side of the transfer material, a second image forming mode in which image formation is conducted only on said other side of the transfer material, and a third image forming mode in which image formation is conducted on both sides of the transfer material. The control device changes a transfer current or a transfer voltage of at least one of the first transfer device and the second transfer device, in accordance with the first, second or third image forming mode.

38 Claims, 16 Drawing Sheets

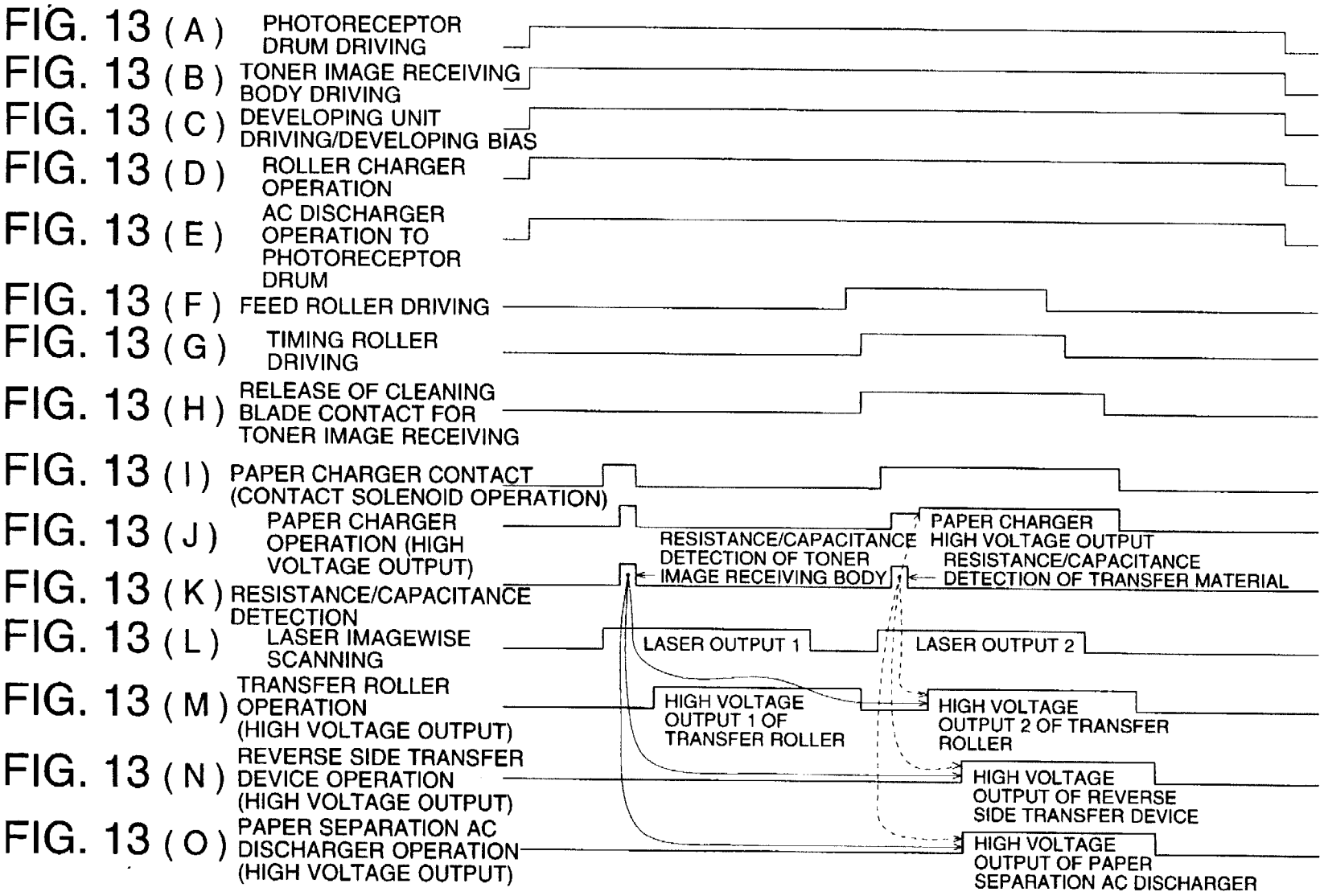
FIG. 13 (A) PHOTORECEPTOR DRUM DRIVING
FIG. 13 (B) TONER IMAGE RECEIVING BODY DRIVING
FIG. 13 (C) DEVELOPING UNIT DRIVING/DEVELOPING BIAS
FIG. 13 (D) ROLLER CHARGER OPERATION
FIG. 13 (E) AC DISCHARGER OPERATION TO PHOTORECEPTOR DRUM
FIG. 13 (F) FEED ROLLER DRIVING
FIG. 13 (G) TIMING ROLLER DRIVING
FIG. 13 (H) RELEASE OF CLEANING BLADE CONTACT FOR TONER IMAGE RECEIVING
FIG. 13 (I) PAPER CHARGER CONTACT (CONTACT SOLENOID OPERATION)
FIG. 13 (J) PAPER CHARGER OPERATION (HIGH VOLTAGE OUTPUT)
FIG. 13 (K) RESISTANCE/CAPACITANCE DETECTION
FIG. 13 (L) LASER IMAGEWISE SCANNING
FIG. 13 (M) TRANSFER ROLLER OPERATION (HIGH VOLTAGE OUTPUT)
FIG. 13 (N) REVERSE SIDE TRANSFER DEVICE OPERATION (HIGH VOLTAGE OUTPUT)
FIG. 13 (O) PAPER SEPARATION AC DISCHARGER OPERATION (HIGH VOLTAGE OUTPUT)
RESISTANCE/CAPACITANCE DETECTION OF TONER IMAGE RECEIVING BODY
PAPER CHARGER HIGH VOLTAGE OUTPUT
RESISTANCE/CAPACITANCE DETECTION OF TRANSFER MATERIAL
LASER OUTPUT 1
LASER OUTPUT 2
HIGH VOLTAGE OUTPUT 1 OF TRANSFER ROLLER
HIGH VOLTAGE OUTPUT 2 OF TRANSFER ROLLER
HIGH VOLTAGE OUTPUT OF REVERSE SIDE TRANSFER DEVICE
HIGH VOLTAGE OUTPUT OF PAPER SEPARATION AC DISCHARGER

ELECTROSTATIC IMAGE FORMING APPARATUS WITH TRANSFER CONTROLS FOR DIFFERENT IMAGING MODES

BACKGROUND OF THE INVENTION

The present invention relates to an electrophotographic type image forming apparatus such as a copier, printer, facsimile device, or similar devices, in which a charging means, an image exposure means, and developing means are arranged around an image carrier, and a toner image formed on the image carrier is transferred onto a transfer material.

Conventionally, in two-sided image formation, an image forming method is used in which a one-side image formed the image carrier is transferred onto a transfer material and fixed; the transfer material is temporarily accommodated in an intermediate tray; the transfer sheet is fed from the intermediate tray in timed relationship with the image formed again on the image carrier; and the other side image is transferred onto the transfer material, and fixed.

As described above, in this two-sided image forming apparatus, conveyance of the transfer material such as feeding to the intermediate tray, and two times passage through the fixing device, is carried out. Accordingly, reliability of the transfer material conveyance is low, and jamming is sometimes caused. With respect to this, a method in which fixing is carried out only once after toner images have been formed on two sides of the transfer sheet, is proposed in Japanese Patent Publication Nos. 37538/1974, 28740/1979, and Japanese Patent Publication Open to Public Inspection Nos. 44457/1989 and 214576/1992. Specifically, a method in which a plurality of sets of image forming means, composed of image carrier, charging means, image exposure means, and developing means, are arranged in parallel on a toner image receiving body, and thereby a two-sided color image is formed, is proposed in Japanese Patent Publication Open to Public Inspection Nos. 44457/1989, 214576/1992, or the like.

Similarly, the inventors of the present invention produced an image forming apparatus, in which a plurality of sets of image forming means, composed of a charging means, image exposure means, developing means, or the like, are arranged around a first image carrier (photoreceptor drum); after superimposed color toner images formed on the photoreceptor drum are temporarily and collectively transferred onto a second image carrier(toner image receiving body) by a first transfer means, superimposed color toner images are formed again on the photoreceptor drum; a transfer material, fed in timed relationship with the toner images on the photoreceptor drum and the toner images on the toner image receiving body, is electrically charged by a transfer material charging means, and attracted to the toner image receiving body; toner images on the photoreceptor drum are transferred by the first transfer means as an obverse side image, and toner images on the toner image receiving body are transferred by the second transfer means by a reverse side image, respectively onto two sides of the transfer material conveyed on the toner image receiving body; after that, the transfer material is separated from the toner image receiving body by a transfer material separation means; and the toner images on the transfer material are fixed by a fixing means; and a two-sided color image is formed. The inventors are investigating, using the apparatus, two-sided image formation (images are formed on both surfaces of the transfer material), one-sided image formation for only the obverse side image (an image is formed on only the obverse side of the transfer material), and one-sided image formation for only the reverse side image (an image is formed on only the reverse side of the transfer material).

However, when the value of a transfer current or transfer voltage of the first transfer means, by which toner image for the obverse side image on the photoreceptor drum is transferred onto the obverse side of the transfer material, in the case where images are formed on two sides of the transfer material, is the same as that in the case where an image is formed on only the obverse side of the transfer material, a problem occurs in which transferring from the photoreceptor drum onto the obverse side of the transfer material is influenced depending on the existence or non-existence of the toner image on the toner image receiving body, and the toner image for the obverse side image is not necessarily finely transferred onto the transfer material.

In the same manner, when the value of a transfer current or transfer voltage of the second transfer means, by which toner image for the reverse side image on the toner image receiving body is transferred onto the reverse side of the transfer material, in the case where images are formed on two sides of the transfer material, is the same as that in the case where an image is formed on only the reverse side of the transfer material, a problem also occurs in which transferring from the toner image receiving body onto the reverse side of the transfer material is influenced depending on the existence or non-existence of the toner image on the obverse side of the transfer material, and the toner image for the reverse side image is not necessarily finely transferred onto the transfer material.

Further, in the case where images are formed on two sides of the transfer material, when a value of a transfer current or transfer voltage of the first transfer means when the toner image for the reverse side image, formed on the photoreceptor drum, is transferred onto the toner image receiving body, is the same as that of the first transfer means when the toner image for the obverse side image on the photoreceptor drum is transferred onto the obverse side of the transfer material, the transfer electric field is differently formed depending on the existence or non-existence of the transfer material. Thereby, transfer property is influenced, and a problem occurs in which transferring of the toner image formed on the photoreceptor drum, onto the toner image receiving body, or transferring onto the obverse side of the transfer material, is not necessarily finely conducted.

Further, when a value of a charging current or charging voltage of a transfer material charging means, by which the transfer material is charged at a supply portion of the transfer material to the toner image receiving body, and is attracted to the toner image receiving body, in the case where the image is formed on only the obverse side of the transfer material, is the same as that in the case where the image is formed on two sides or only the reverse side of the transfer material, a further problem occurs in which the close adherence property of the transfer material to the toner image receiving body is influenced depending on the existence or non-existence of the toner image on the toner image receiving body, and thereby, the conveyance of the transfer material by the toner image receiving body is not finely conducted, or the toner image on the toner image receiving body is disturbed, so that the image is disturbed.

Still further, when a value of a discharging current or discharging voltage of a transfer material separation means, by which the transfer material is separated at a separating portion of the transfer material from the toner image receiving body, in the case where the image is formed on only the obverse side of the transfer material, is the same as that in the case where the image is formed on only the reverse side or images are formed on the two sides of the transfer material, a still further problem occurs in which an amount of electric charges accumulated on the transfer material is different depending on the existence or non-existence of the toner image on the obverse side or reverse side of the transfer material, and thereby, the separation property of the transfer material is influenced, so that the transfer material is not finely separated.

A yet further problem occurs in which transferring of the toner image onto the toner image receiving body or the transfer material, or charging or separation of the transfer material, is not finely conducted, depending on types of the transfer material, changes of environmental conditions, or changes or deterioration of the toner image receiving body due to repeated uses, or the like.

SUMMARY OF THE INVENTION

An object of the present invention is to solve the above problems and to provide an image forming apparatus in which, in any of cases where images are formed on two sides of a transfer material, an image is formed on only an obverse side of the transfer material, and an image is formed on only a reverse side of the transfer material, transferring of a toner image onto a toner image receiving body or the transfer material is finely conducted, and also conveyance of the transfer material and separation of the transfer material are finely conducted.

Further object of the present invention is to provide an image forming apparatus in which transferring of the toner image onto the toner image receiving body or the transfer material, and charging or separation of the transfer material are finely conducted, without depending on types of the transfer material, changes of environmental conditions, or changes or deterioration of the toner image receiving body caused by repeated uses.

The above objects are attained by the following image forming apparatus. An image forming apparatus has: a first image carrier; a toner image forming means for forming a toner image on the first image carrier; a second image carrier provided opposite to the first image carrier for carrying a transferred toner image; a first transferring means for transferring the toner image on the first image carrier onto the second image carrier, or for transferring the toner image on the first image carrier onto one side of a transfer material; a second transferring means for transferring the toner image carried on the second image carrier onto the other side of the transfer material; a fixing means for fixing at least one of the toner image on said one side of the transfer material on which the toner image has been transferred by the first transferring means and the toner image on said other side of the transfer material on which the toner image has been transferred by the second transferring means; and a control means for controlling the toner image forming means, the first transferring means and the second transferring means, wherein the control means has a first image forming mode in which image formation is conducted only on said one side of the transfer material, a second image forming mode in which image formation is conducted only on said other side of the transfer material, and a third image forming mode in which image formation is conducted on both sides of the transfer material, and wherein the control means changes a transfer current or a transfer voltage of at least one of the first transferring means and the second transferring means, in accordance with the first, second or third image forming mode.

BRIEF DESCRIPTION OF THE DRAWINGS

FIGS. 13(A) through 13(O) are timing charts of image forming processes according to the second example.

DETAILED DESCRIPTION OF THE PREFERRED EMBODIMENT

An example of the present invention will be described below. Incidentally, in the following explanation of the example, the surface of a transfer material on the side opposite to an image carrier in a transfer area is called an obverse side, and the surface on the other side of the transfer material, that is, the surface of the transfer material on the side opposite to the second image carrier is called a reverse side. An image transferred onto the obverse side of the transfer material is called an obverse side image, and an image transferred onto the other side surface of the transfer material is called a reverse side image.

Further, in the following description, when it is explained that a value of a charging current or a charging voltage of a transfer material charging means, a value of a transfer current or a transfer voltage of a first transfer means, and a value of a transfer current or a transfer voltage of a second transfer means, is made large, it implies that an absolute value for each value is made large. On the other hand, when it is explained that a value of a discharging current or a discharging voltage of a transfer material separation means is made large, it implies that an AC current or an AC voltage is simply made large. However, in the case where the discharging current or the discharging voltage of the transfer material separation means includes a DC component, it implies that an absolute value of the DC component of the current or the voltage of the transfer material separation means is made large.

EXAMPLE 1

Figure 1:
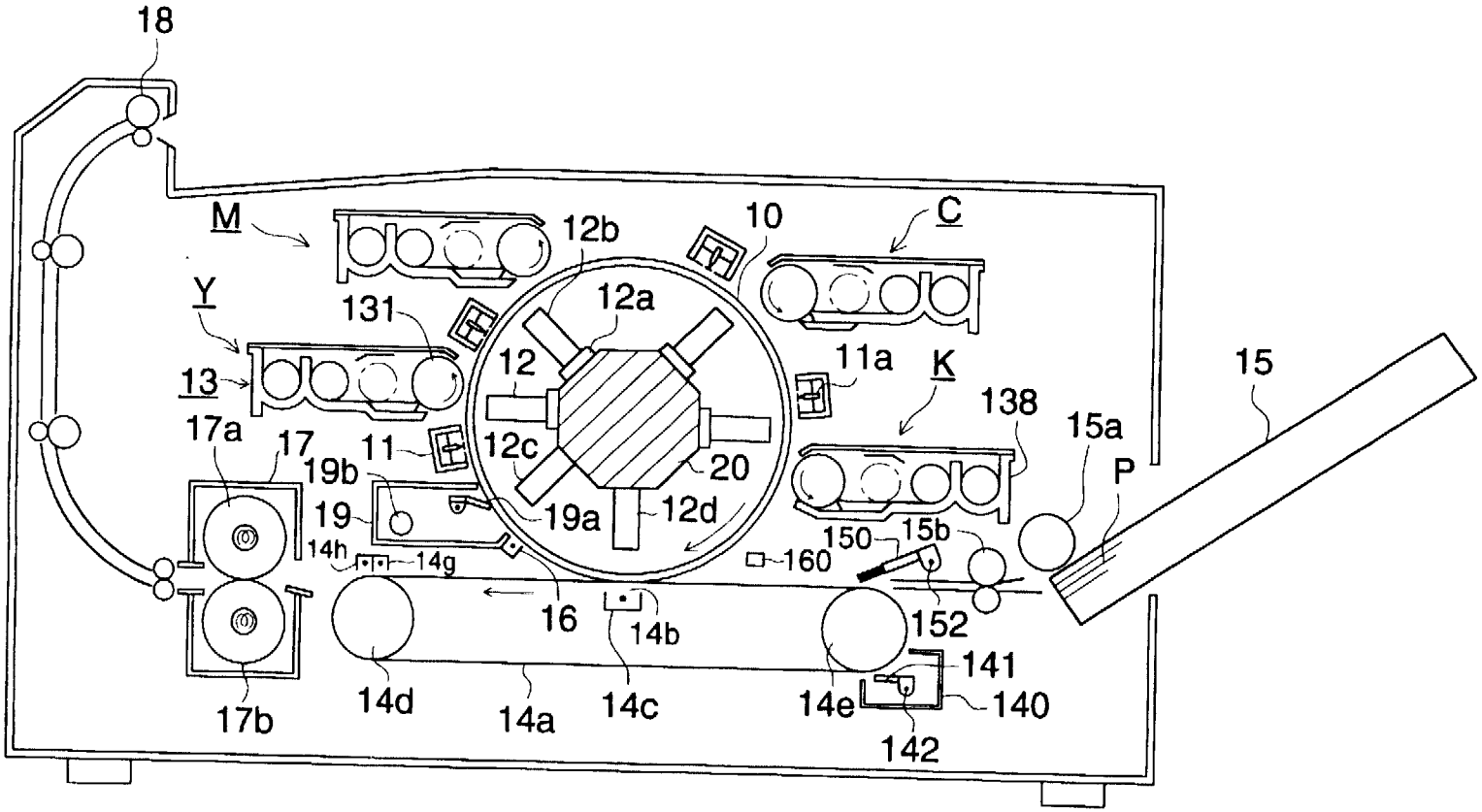
FIG. 1 is a sectional view of the structure of a color image forming apparatus showing the first example of an image forming apparatus of the present invention.
Figure 2:
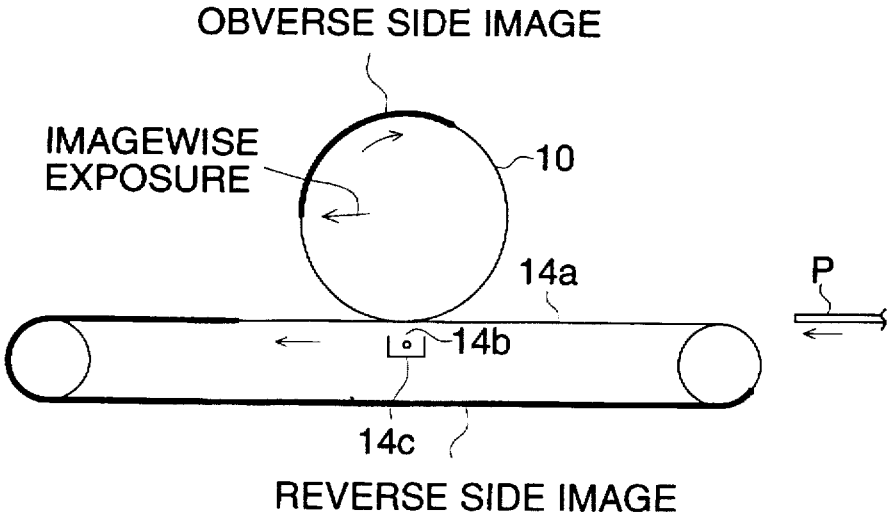
FIG. 2 is a view showing the toner image forming condition and supply of the transfer material when images are formed on two sides of the transfer material by the image forming apparatus of the present invention.
Figure 3:
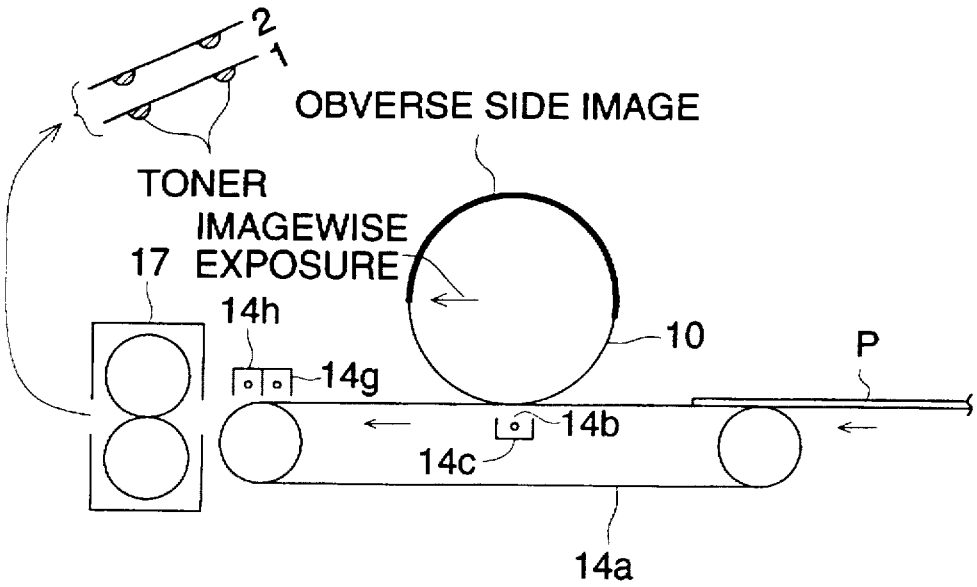
FIGS. 3(A) and 3(B) are views showing toner image forming conditions and supply and delivery of the transfer material when an image is formed on only an obverse side or a reverse side of the transfer material by the image forming apparatus of the present invention.
Figure 3:
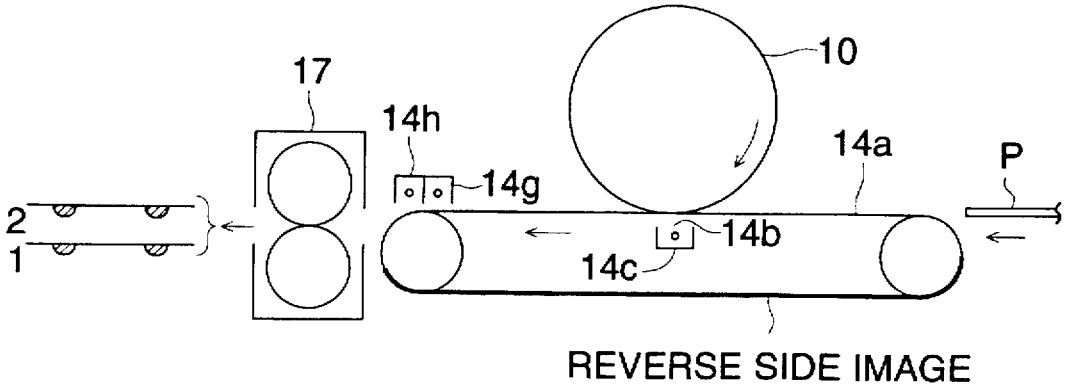

Referring to FIGS. 1 through 3(B), image forming processes and each mechanism of the first example of an image forming apparatus of the present invention will be described below. FIG. 1 is a sectional view of the structure of a color image forming apparatus showing the first example of an image forming apparatus of the present invention. FIG. 2 is a view showing toner image forming conditions and supply of the transfer material when image formation is conducted on two sides of the transfer material by the image forming apparatus of the present invention. FIGS. 3(A) and 3(B) are views showing toner image forming conditions, and supply and delivery of the transfer material when image formation is conducted on only the obverse side or reverse side of the transfer material by the image forming apparatus of the present invention. FIG. 3(A) is a view showing the obverse side image formation, and FIG. 3(B) is a view showing the reverse side image formation.

A photoreceptor drum 10, serving as the first image carrier, is structured, for example, such that a transparent conductive layer, and a photoreceptor layer such as an a-Si layer or an organic photoreceptor layer (OPC), are formed on the outer periphery of a cylindrical substrate, formed of a transparent member such as optical glass, or transparent acrylic resin, and is rotated clockwise, as shown by an arrow in FIG. 1, while being electrically grounded.

Scorotron chargers 11 as a charging means, exposure units 12 as an image exposure means, and developing devices 13 as a developing means are respectively used for each color image formation process of yellow (Y), magenta (M), cyan (C) and black (K), and are arranged in the order of Y, M, C and K with respect to the rotating direction of the photoreceptor drum 10 as shown by an arrow in FIG. 1, in the present example.

The scorotron charger 11 as the charging means for each color, is structured by a corona discharging electrode 11*a*, composed of a saw-toothed electrode or a wire electrode, and a control grid which has a predetermined potential voltage with respect to the organic photoreceptor layer of the photoreceptor drum 10, and is located closely facing the photoreceptor drum 10 in the direction perpendicular to the moving direction of the photoreceptor drum 10. The scorotron charger 11 conducts corona discharging with the same polarity as toner (in the present example, negative charging), so that uniform potential voltage is applied on the photoreceptor drum 10.

The exposure unit 12 as an image exposure means for each color, are arranged inside the photoreceptor drum 10 such that the exposure position on the photoreceptor drum 10 is downstream of the rotating direction of the photoreceptor drum 10 with respect to the scorotron charger 11 for each color.

The exposure unit 12 for each color is structured as a unit for exposure in which a linear exposure element 12*a* and a Selfoc lens 12*b* as a life-sized image forming element are mounted on a holder, not shown in the drawing, wherein the linear exposure element 12*a* is structured such that a plurality of LEDs (light emitting diode) 121 as a light emitting element for image exposure light, are aligned array-like along the axis of photoreceptor drum 10. The exposure unit 12 for each color is attached to a holding member 20 together with a uniform exposure device 12*c* and a transfer simultaneous exposure device 12*d*. When the holding member 20 is fixed to an apparatus main body, the exposure unit 12 for each color, the uniform exposure device 12*c* and the transfer simultaneous exposure device 12*d* are integrally accommodated inside the substrate for the photoreceptor drum 10. As the exposure element, a linear exposure element other than the above element, may be used, in which a plurality of light emitting elements such as an FL (fluorescent substance light emission), EL (electroluminescence), PL (plasma discharge), etc., are aligned array-like. The exposure unit 12 image-exposures the photoreceptor drum 10 according to image data for each color, which has been read by an image reading apparatus, separately provided from the apparatus, and stored in a memory, and a latent image is formed on the photoreceptor drum 10. The wavelength of light emission of the light emitting element used in the present example, is preferable within the range of 680–900 nm, within which usually, permeability of Y, M, C and K toner is high. However, image exposure is conducted from the rear surface, and therefore, the shorter wavelength, which has rather insufficient transparency for color toner, may be allowable.

A developing device 13 as a developing means for each color, is respectively provided with a developing sleeve 131, serving as a developer carrier, which is formed of, for example, cylindrical non-magnetic stainless steel or aluminum material with 0.8–1 mm thickness and 15–25 mm outer diameter, and a development casing 138, in which one-component or two-component developer of Y, M, C and K is respectively accommodated. The developing sleeve 131 is kept to be in non-contact with the photoreceptor drum 10 with a predetermined interval of, for example, 100–1000 μm, by a roller, not shown in the drawing, and is rotated in the same direction as the photoreceptor drum 10 at the position facing the photoreceptor drum 10. When DC voltage with the same polarity as toner (in the present example, negative voltage) as developing bias voltage, or superimposed voltage of DC and AC voltage is applied onto the developing sleeve 131, reversal development is conducted on an exposed portion of the photoreceptor drum 10 without contacting with each other. In this case, the development interval accuracy of less than approximately 20 μm is necessary for preventing image unevenness.

A toner image receiving body 14*a* as the second image carrier, is an endless belt stretched between a dive roller 14*d* and a driven roller 14*e*, and is in contact with the photoreceptor drum 10. The belt has the 2 layer construction in which, for example, 5–50 μm thick semi-conductive fluorine coating, as a toner filming prevention layer, is conducted outside the semi-conductive rubber belt substrate, formed of silicon rubber or urethane rubber of 0.5–2.0 mm thick, and $10^8$–$10^{14}$ Ω.cm volume resistivity. Other then the rubber belt substrate, semi-conductive polyester, polystyrene, polyethylene, polyethylene terephthalate, polyimide, modified polyimide, ETFE (ethylene-tetrafluoro ethylene copolymer, etc., of 0.1–0.5 mm thick, and $10^8$–$10^{14}$ Ω.cm volume resistivity, may be used.

A paper charger 150 as a transfer material charging means, is a charging brush which is rotatable around a support shaft 152, and can in contact with and contact-released from the toner image receiving body 14*a*, and is arranged opposite to the grounded driven roller 14*e* by which the toner image receiving body 14*a* is stretched. The paper charger 150 is in contact with the toner image receiving body 14*a* through a recording sheet P, during passage of the recording sheet P as the transfer material. Just before the passage of the trailing edge of the recording sheet P or simultaneously with the passage, the paper charger 150 is released from the contact with the toner image receiving body 14*a*, and is separated from the recording sheet P. The recording sheet P is charged by applying a DC voltage with the same polarity as toner onto the paper charger 150 when the recording sheet P passes the paper charger 150, and the recording sheet P is attracted to the toner image receiving body 14*a* and sent to the transfer area 14*b*. When the recording sheet P is paper-charged with the same polarity as toner, the recording sheet p is prevented from being attracted to the toner image on the toner image receiving body 14*a*, or the toner image on the photoreceptor drum 10, and thereby, the toner image is prevented from being disturbed. As the transfer material charging means, a conductive roller or a conductive film, which can be in contact with and contact-released from the toner image receiving body 14*a*, may also be used other than the above paper charger.

The transfer device 14*c* as the first transfer means, is the scorotron charger onto which a voltage with the reverse polarity to the toner (in the present example, positive polarity) is applied, and is arranged opposite to the photoreceptor drum 10 through the toner image receiving body 14*a*. The transfer device 14*c* charges the rear surface of the toner image receiving body 14*a* with the reverse polarity to the toner, and thereby, a transfer area 14*b* is formed between the toner image receiving body 14*a* and the photoreceptor drum 10. The transfer device 14*c* transfers the toner image of the reverse side image on the photoreceptor drum 10 onto the toner image receiving body 14*a*, and further, the toner image of the obverse side image on the photoreceptor drum 10 onto the obverse side of the recording sheet P.

A reverse side transfer device 14*g* as the second transfer means, is a corotron charger onto which voltage with the reverse polarity to the toner (in the present example, positive polarity) is applied, and is arranged on the obverse surface side of the recording sheet P, which is conveyed on the toner image receiving body 14*a*, being opposed to a grounded driven roller 14*d*. The reverse side transfer device 14*g* charges the obverse side of the recording sheet P with the reverse polarity to the toner, and transfers the toner image of the reverse side image on the toner image receiving body 14*a* onto the reverse side of the recording sheet P.

A paper separation AC discharger 14*h* as a transfer material separation means, is a corotron charger onto which AC voltage or superimposed voltage of AC voltage and DC voltage is applied, and arranged on the obverse surface side of the recording sheet P, which is conveyed on the toner image receiving body 14*a*, being opposite to the grounded drive roller 14*d*. The paper separation AC discharger 14*h* discharges the recording sheet P at a separation portion of the recording sheet P from the toner image receiving body 14*a*, and is separated from the toner image receiving body 14*a*.

A fixing device 17 as a fixing means, is a heat roller fixing device composed of a fixing roller 17*a* and a pressure-contact roller 17*b*, both of which house a heater therein. The fixing device 17 nips the recording sheet P, which has been separated from the toner image receiving body 14*a* and has toner images on the both sides, between the fixing roller 17*a* and the pressure-contact roller 17*b*, and conveys the recording sheet P. Thereby, heat and pressure are applied onto the recording sheet P, so that the toner image on the recording sheet P is fixed.

When image recording is started, the photoreceptor drum 10 is rotated clockwise as shown by an arrow in FIG. 1, by the start of a photoreceptor driving motor, not shown in the drawing, and potential voltage is applied on the photoreceptor drum 10 by a charging action of a yellow (Y) scorotron charger 11.

Further, as a document image, an image, read by an image pick-up element of an image reading apparatus, separately provided from the present apparatus, or edited by a computer, is temporarily stored in a memory as image data for each color of Y, M, C and K.

After potential voltage has been applied onto the photoreceptor drum 10, exposure scanning by electric signals corresponding to the first color signal, that is, Y image data is started by a Y exposure unit 12, and an electrostatic latent image corresponding to the Y image of the document image is formed on the surface of the photoreceptor drum 10.

The Y electrostatic latent image formed on the photoreceptor drum 10 is reversal developed under non-contact condition by the Y developing device 13, and a yellow (Y) toner image is formed on the photoreceptor drum 10.

Next, the potential voltage is applied on the toner image formed on the photoreceptor drum 10 by a charging action of a magenta (M) scorotron charger 11, and exposure by electric signals corresponding to the second color signal, that is, M image data is conducted by an M exposure unit 12, so that an M electrostatic latent image is formed. The M electrostatic latent image is reversal developed under non-contact condition by an M developing device 13, and a magenta (M) toner image is formed on the yellow (Y) toner image by superimposition.

In the same process, a cyan (C) toner image corresponding to the third color signal is formed by a cyan (C) scorotron charger 11, a C exposure unit 12 and a C developing device 13, and a black (K) toner image corresponding to the fourth color signal is successively formed by superimposition by a black (K) scorotron charger 11, a K exposure unit 12 and a K developing device 13. Then, a superimposed color toner image of Y, M, C, K is formed on the peripheral surface of the photoreceptor drum 10 during a single rotation of the photoreceptor drum 10,(a toner image forming means).

The exposure onto the organic photoreceptor layer of the photoreceptor drum 10 by the exposure unit 12 of Y, M, C, K, is conducted through the transparent substrate from the inside of the drum, and thereby, the exposure onto images corresponding to the second, third, and fourth color signals, can be conducted without being influenced by the previously formed toner image, and the electrostatic latent image having the same quality as the image corresponding to the first color signal can be formed.

By the above image forming processes, a superimposed color toner image, which is a reverse side image, is formed on the photoreceptor drum 10, serving as the first image carrier, and is collectively transferred onto the toner image receiving body 14*a*, serving as the second image carrier, in the transfer area 14*b* by the transfer device 14*c*. In this case, uniform exposure by the transfer simultaneous exposure device 12*d* using, for example, light emitting diodes, may be conducted so that fine transferring can be carried out.

Toner remaining on the peripheral surface of the photoreceptor drum 10 after transfer, is discharged by a photoreceptor drum AC discharger 16, and after that, moved to a cleaning device 19 as a cleaning means of the photoreceptor drum 10, cleaned by a cleaning blade 19*a* formed of rubber material in contact with the photoreceptor drum 10, and is collected into a waste toner container, not shown, by a screw 19*b*. The peripheral surface of the photoreceptor drum 10 is discharged by exposure by a pre-charging uniform exposure device 12*c* using, for example, light emitting diodes, and hysteresis of the photoreceptor drum 10 due to previous image formation, is eliminated.

After a superimposed color toner image, which is a reverse side image, has been formed on the photoreceptor drum 10 due to the foregoing, succeedingly, in the sane manner as the above color image forming processes, a superimposed color toner image, which is an obverse side image, is formed on the photoreceptor drum 10. In this connection, it is necessary to change image data so that the obverse side image formed on the photoreceptor drum 10 forms a mirror image with respect to the previously formed reverse side image.

The recording sheet P, serving as the transfer material, is sent from a sheet feed cassette 15, which is a transfer sheet accommodation means, to a timing roller 15*b* by a feeding roller 15*a*, and the recording sheet P is in timed relationship with the color toner image of the obverse side image carried on the photoreceptor drum 10, and the color toner image of the reverse side image carried on the toner image receiving body 14*a*, by the drive of the timing roller 15*b*, as shown in FIG. 2, and is sent to the paper charger 150.

The paper charger 150 is in contact with the recording sheet P during passage of the recording sheet P, and charges the recording sheet P. The recording sheet P is attracted to the toner image receiving body 14*a* through the color toner image of the reverse side image carried on the toner image receiving body 14*a*, and is sent to the transfer area 14*b* as the toner image receiving body 14*a* moves.

In the transfer area 14*b*, the color toner image of the obverse side image on the photoreceptor drum 10 is collectively transferred onto the obverse side of the recording sheet P by the transfer device 14*c* as the first transfer means. In this case, the color toner image of the reverse side image carried on the toner image receiving body 14*a* is not transferred onto the recording sheet P, but remains on the toner image receiving body 14*a*. In this connection, uniform exposure may be conducted by the transfer simultaneous exposure device 12*d*, which is provided inside the photoreceptor drum 10 and opposite to the transfer device 14*c*, using, for example, light emitting diodes, so that transfer can be finely conducted in the case of transfer by the transfer device 14*c*.

The recording sheet P, onto the obverse side of which the color toner image is transferred, is conveyed to a reverse side transfer device 14*g* as the second transfer means, and the color toner image of the reverse side image carried on the toner image receiving body 14*a* is collectively transferred onto the reverse side of the recording sheet P by the reverse side transfer device 14*g*.

By the foregoing operations, the recording sheet P, onto two sides of which the color toner image is transferred, is discharged by the paper separation AC discharger 14*h* for the transfer material separation, and is separated from the toner image receiving body 14*a*.

The recording sheet P separated from the toner image receiving body 14*a*, is conveyed to the fixing device 17 as the fixing means, and after toner adhered to the obverse side and reverse side of the recording sheet P, has been fixed by heat and pressure, the recording sheet P is delivered to a tray provided outside the apparatus through the discharging roller 18.

Toner, remaining on the toner image receiving body 14*a* after the toner image of the reverse side image has been transferred onto the recording sheet P, is removed by a toner image receiving body cleaning device 140, which is a cleaning means provided opposite to the driven roller 14*e* and which has a toner image receiving body cleaning blade 141, as a blade member, which can be rotated around the support shaft 142 and can be in contact with and contact-released from the toner image receiving body 14*a*. In this connection, the contact-release and contact operation of the toner image receiving body cleaning blade 141 is performed by ON/OFF operation of a contact release solenoid, not shown in the drawing.

The toner remaining on the photoreceptor drum 10 after the toner image of the obverse side image has been transferred onto the recording sheet P, is discharged by a photoreceptor drum AC discharger 16 in the same manner as in the case of reverse side image formation, and after that, the residual toner is removed by a photoreceptor drum cleaning device 19. The peripheral surface of the photoreceptor drum 10 is discharged by the pre-charging uniform exposure device 12*c*, so that hysteresis of the photoreceptor drum 10 due to the previous image formation is eliminated, and the photoreceptor drum 10 enters the next image information cycle.

In the above image forming apparatus, the superimposed color toner image is collectively transferred onto the recording sheet P as described above, and color images are formed on two sides of the recording sheet P. Thereby, doubling of the color image, scattering of toner, or frictional damage on the toner image receiving body 14*a*, hardly occurs, and therefore, a fine two-sided color image having smaller image deterioration, can be formed.

The above description is made for the case where images are formed on two sides of the recording sheet P, however, of course, an image can be formed on only the obverse side or reverse side of the recording sheet P.

When image formation is conducted on only the obverse side, as shown in FIG. 3(A), the recording sheet P is sent to the transfer area 14b so as to be synchronized with the color toner image of the obverse side image formed on the photoreceptor drum 10; the toner image of the obverse side image is collectively transferred onto the obverse side of the recording sheet P by the transfer device 14c; the recording sheet P, on the obverse side of which the toner image is formed, is discharged by the paper separation AC discharger 14h and separated from the toner image receiving body 14a; after that, the recording sheet P is conveyed to the fixing device 17 as the fixing means; the recording sheet P is reversed on the delivery path to the discharging roller 18; and the recording sheet P is delivered onto a tray provided outside the apparatus with the toner image side facing downward thereby the sheets are put in the sequence of pages.

When the image formation is conducted on only the reverse side of the transfer material, as shown in FIG. 3(B), the color toner image of the reverse side image formed on the photoreceptor drum 10, is temporarily transferred onto the toner image receiving body 14a collectively by the transfer device 14c; next, the recording sheet P is sent to the transfer area 14b so that the recording sheet P is in timed relationship with the color toner image of the reverse side image, transferred onto the toner image receiving body 14a; the toner image of the reverse side image is collectively transferred onto the reverse side of the recording sheet P by the reverse side transfer device 14g; the recording sheet P, on the reverse side of which the toner image has been formed, is discharged by the paper separation AC discharger 14h and is separated from the toner image receiving body 14a; then, the recording sheet P is conveyed to the fixing device 17 as the fixing means; a delivery path is switched by a delivery path switching member, not shown in the drawing, and conveyed approximately horizontally; and the recording sheet P is delivered on the tray, not shown, provided outside the apparatus with the toner image surface facing upward.

Incidentally, in the present apparatus, as shown in FIG. 1, a humidity detection sensor 160 to detect, for example, the humidity in the apparatus, is provided at the position close to the photoreceptor drum 10 and to the toner image receiving body 14a, as a sensor to measure environmental conditions in the apparatus. The charging condition by the paper charger 150, the transfer condition by the transfer device 14c and the reverse side transfer device 14g, the discharging condition by the paper separation AC discharger 14h, etc., are controlled corresponding to the result of detection of the sensor. Further, as a sensor to measure the environmental condition in the apparatus, a temperature sensor, or the like, may be provided other than the above sensor.

Figure 4:
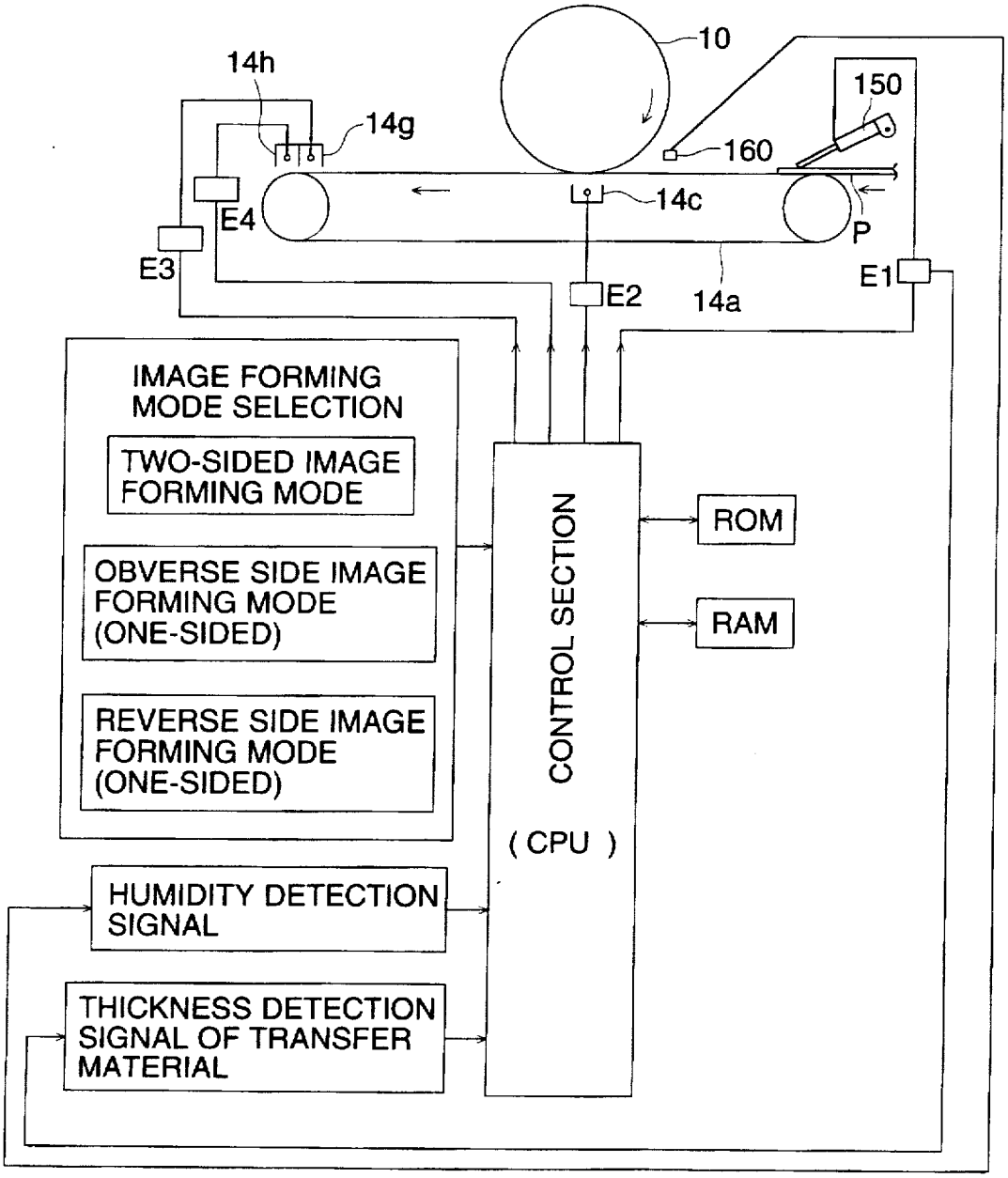
FIG. 4 is a block diagram showing the control of a transfer current of the first transfer means, a transfer current of the second transfer means, a charging current of a transfer material charging means, and a discharging current of a transfer material separation means in the first example.
Figure 5:
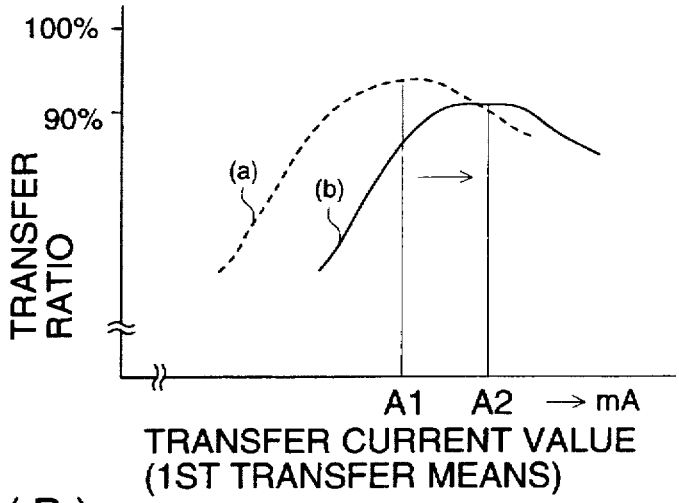
FIGS. 5(A), 5(B) and 5(C) are views showing transfer characteristics when image formation is conducted on only the obverse side or reverse side of the transfer material, or two sides of the transfer material.
Figure 5:
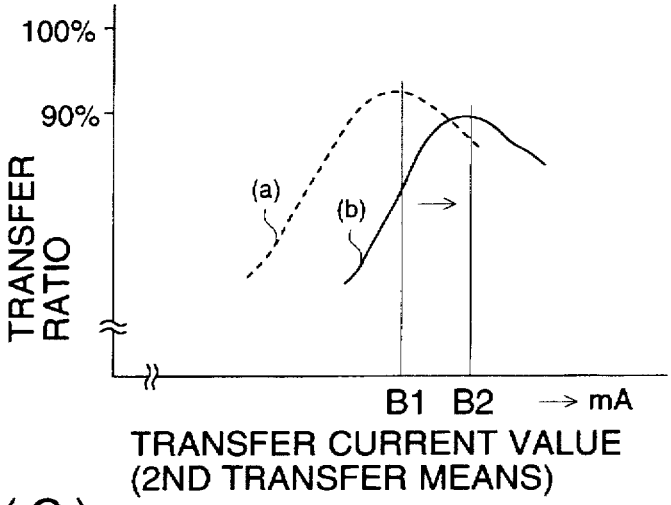
Figure 5:
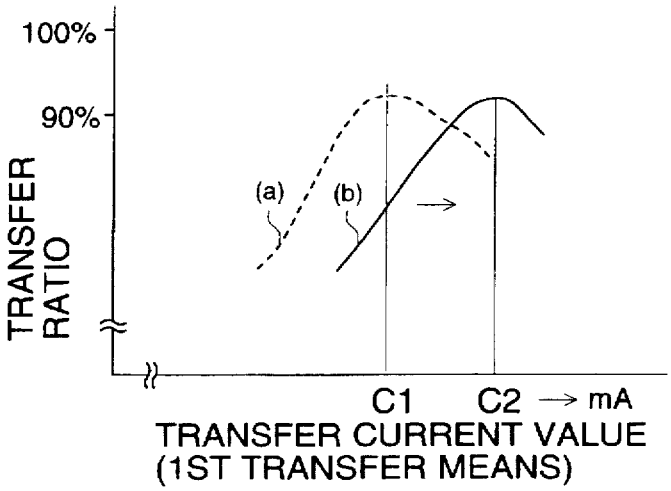
Figure 6:
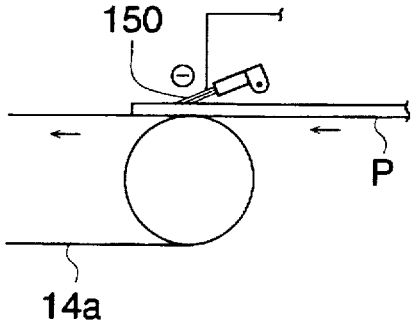
FIGS. 6(A) and 6(B) are views showing charging of the transfer material and attracting condition of the transfer material to the second image carrier when the transfer material is supplied to the second image carrier.
Figure 6:
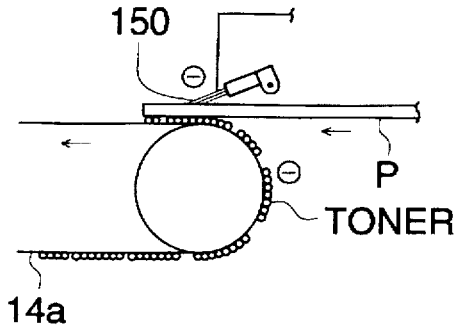

Next, referring to FIGS. 4 through 6, the control of transfer current of the first transfer means, transfer current of the second transfer means, charging current of the transfer material charging means, and discharging current of the transfer material separation means, in the first example of the present invention, will be described. FIG. 4 is a block diagram showing the control of transfer current of the first transfer means, transfer current of the second transfer means, charging current of the transfer material charging means, and discharging current of the transfer material separation means, in the first example of the present invention. FIGS. 5(A) through 5(C) are views showing transfer characteristics when the image formation is conducted on only the obverse side, reverse side, or two sides of the transfer material. FIG. 5(A) is a view showing the transfer characteristics when the toner image of the obverse side image carried on the first image carrier is transferred onto the obverse side of the transfer material by the first transfer means in the two-sided image formation and the obverse side image formation. FIG. 5(B) is a view showing the transfer characteristics when the toner image of the reverse side image carried on the second image carrier is transferred onto the reverse side of the transfer material by the second transfer means in the two-sided image formation and the reverse side image formation. FIG. 5(C) is a view showing the transfer characteristics when the toner image of the reverse side image and the toner image of the obverse side image, carried on the first image carrier, are respectively transferred the obverse side of the second image carrier or the transfer material by the first transfer means in the two-sided image formation. FIGS. 6(A) and 6(B) are views showing charging of the transfer material, and conditions of attraction of the transfer material to the second image carrier, when the transfer material is fed to the second image carrier. FIG. 6(A) is a view showing the condition at the time of the obverse side image formation. FIG. 6(B) is a view showing the condition at the time of two-side image formation and reverse side image formation.

In FIG. 4, numeral 10 is a photoreceptor drum as the first image carrier, numeral 14a is a toner image receiving body as the second image carrier, numeral 150 is a paper charger as a transfer material charging means, numeral 14c is a transfer device as the first transfer means, numeral 14g is a reverse side transfer device as the second transfer means, and numeral 14h is a paper separation AC discharger as a transfer material separation means. Numeral E1 is a DC constant current power source to supply a charging current to the paper charger 150, numeral E2 is a DC constant current power source to supply a transfer current to the transfer device 14c, numeral E3 is a DC constant current power source to supply a transfer current to the reverse side transfer device 14g, and E4 is an AC constant current power source to supply a discharging current to a paper separation AC discharger 14h.

In the present apparatus, an image forming mode is selected among a two-sided image forming mode, an obverse side image forming mode, and a reverse side image forming mode by an operation section, not shown, and respective image formation is carried out. In this case, the optimum current value according to an image forming mode, which is previously determined by experiments and stored in a ROM, RAM as a memory means, is read from the ROM or RAM through a control section corresponding to the selected image forming mode, and correction of the transfer current value of the transfer device 14c by the DC constant current power source E2, the transfer current value of the reverse side transfer device 14g by the Dc constant current power source E3, the charging current value of the paper charger 150 by the DC constant current power source E1, and the discharging current value of the paper separation AC discharger 14h by the AC constant current power source E4, is carried out.

FIG. 5(A) is a view showing transfer characteristics in the case where the toner image of the obverse side image carried on the photoreceptor drum 10 is transferred onto the obverse side of the recording sheet P by the transfer device 14c as the first transfer means, when 45–55 kg/m$^2$ paper thickness plain paper is used under environmental conditions of normal temperature and normal humidity (20°±5° C., 45±10%). A curve (a) shows the case of the obverse side image forming mode, and a curve (b) shows the case of the two-sided image forming mode.

The optimum transfer current value in the case of the two-sided image forming mode is lager than that in the case of the obverse side image forming mode. This is considered for the reason why the toner image of the reverse side image exists between the reverse side of the recording sheet P and the toner image receiving body 14*a*, in the case of the two-sided image forming mode, and thereby, the strength of transfer electric field is reduced.

In order to obtain excellent transfer property in both cases of two-sided image forming mode and obverse side image forming mode, it is necessary to set a transfer current value A2 in the case of the two-sided image forming mode, larger than a transfer current value A1 in the case of the obverse side image forming mode. For example, the transfer current value to the transfer device 14*c* when the toner image of the obverse side image carried on the photoreceptor drum 10 is transferred on the obverse side of the recording sheet P is changed in the case of the two-sided image forming mode and in the case of the obverse side image forming mode, so that, for example, A2 is 0.3–0.7 mA, and A1 is 0.2–0.6 mA.

FIG. 5(B) is a view showing transfer characteristics in the case where the toner image of the reverse side image carried on the toner image receiving body 14*a* is transferred onto the reverse side of the recording sheet P by the transfer device 14*g* as the second transfer means, when 45–55 kg/m$^2$ paper thickness plain paper is used under environmental conditions of normal temperature and normal humidity (20°±5° C., 45±10%). A curve (a) shows the case of the reverse side image forming mode, and a curve (b) shows the case of the two-sided image forming mode.

The optimum transfer current value in the case of the two-sided image forming mode is lager than that in the case of the reverse side image forming mode. This is considered for the reason why the toner image of the obverse side image exists on the obverse side of the recording sheet P, in the case of the two-sided image forming mode, and thereby, the strength of transfer electric field is reduced.

In order to obtain excellent transfer property in both cases of two-sided image forming mode and reverse side image forming mode, it is necessary to set a transfer current value B2 in the case of the two-sided image forming mode, larger than a transfer current value B1 in the case of the reverse side image forming mode. For example, the transfer current value to the reverse side transfer device 14*g*, when the toner image of the reverse side image carried on the toner image receiving body 14*a* is transferred on the reverse side of the recording sheet P, is changed in the case of the two-sided image forming mode and in the case of the reverse side image forming mode, so that, for example, B2 is 0.3–0.6 mA, and B1 is 0.2–0.5 mA.

FIG. 5(C) is a view showing transfer characteristics in the case where the toner image of the reverse side image and the toner image of the obverse side image carried on the photoreceptor drum 10 are respectively transferred onto the toner image receiving body 14*a* or the obverse side of the recording sheet P by the transfer device 14*c* as the first transfer means, when 45–55 kg/m$^2$ paper thickness plain paper is used under environmental conditions of normal temperature and normal humidity (20°±5° C., 45±10%), and the two-sided image forming mode is selected. A curve (a) shows the case of the reverse side image transfer onto the toner image receiving body 14*a*, and a curve (b) shows the case of the obverse side image transfer onto the obverse side of the recording sheet P.

The optimum transfer current value in the case of the obverse side image transfer is lager than that in the case of the reverse side image transfer. This is considered for the reason why the recording sheet P and the toner image of the reverse side image exist between the photoreceptor drum 10 and the toner image receiving body 14*a*, in the case of the obverse side image transfer, and thereby, the strength of transfer electric field is reduced.

In order to obtain excellent transfer property in both cases of the obverse side image transfer and reverse side image transfer, it is necessary to set a transfer current value C2 in the case of the obverse side image transfer larger than a transfer current value C1 in the case of the reverse side image transfer. For example, the transfer current value to the transfer device 14*c*, when the toner image of the reverse side image and the toner image of the obverse side image carried on the photoreceptor drum 10 are respectively transferred onto the toner image receiving body 14*a* or the obverse side of the recording sheet P, is changed in the case of the reverse side image transfer and in the case of the obverse side image transfer, so that, for example, C2 is 0.4–0.8 mA, and C1 is 0.2–0.6 mA.

Further, charging characteristics when the recording sheet P is charged by the paper charger 150 as the transfer material charging means, and is attracted to the toner image receiving body 14*a*, are obtained by experiments when 45–55 kg/m$^2$ paper thickness plain paper is used under environmental conditions of normal temperature and normal humidity (20°±5° C., 45±10%). In this case, the following is confirmed: the optimum charging current value in the case of the reverse side image forming mode or the two-side image forming mode, is larger than that in the case of the obverse side image forming mode; and the optimum charging current value in the case of the reverse side image forming mode is relatively larger than that in the case of the two-side image forming mode. This is considered for the reason why, as shown in FIG. 6, a toner image of the reverse side image with the same polarity as the charged polarity of the recording sheet P by the paper charger 150, exists on the toner image receiving body 14*a*, in the case of the reverse side image forming mode or the two-sided image forming mode, and the attraction force for the recording sheet P to the toner image receiving body 14*a* is reduced by the influence of the toner image. Further, the difference between the case of the reverse side image forming mode and the case of the two-sided image forming mode, is considered as follows: in the case of the two-sided image formation, the close contact property of the recording sheet P with the toner image receiving body 14*a* is increased by the application of voltage by the transfer device 14*c* as the first transfer means when the toner image of the obverse side image on the photoreceptor drum 10 is transferred onto the obverse side of the recording sheet p; in contrast to this, in the case of the reverse side image forming mode, the transfer device 14*c* is not operated, so that the close contact effect is not increased.

In order to obtain an excellent charging and attraction property in any of the cases of the obverse side image mode, the reverse side image mode, and the two-sided image forming mode, it is necessary to increase the charging current value in the case of the two-sided image forming mode more than that in the case of the obverse side image forming mode, and to set the charging current value in the case of the reverse side image forming mode larger than, or equal to, that in the case of the two-sided image forming mode. For example, in any of cases of the obverse side image forming mode, the two-sided image forming mode, or the reverse side image forming mode, the charging current value to the paper charger 150 when the recording sheet P is charged by the paper charger 150 and attracted to the toner image receiving body 14*a*, is changed so that, for example, the charging current value in the case of the obverse side image forming mode is −50 μA, that in the case of the two-sided image forming mode is −70 μA, and that in the case of the reverse side image forming mode is −75 μA.

Discharging characteristics when the recording sheet P is discharged by the paper separation AC discharger 14h as the transfer material separation means, and is separated from the toner image receiving body 14a, are searched by experiments when 45–55 kg/m$^2$ paper thickness plain paper is used under environmental conditions of normal temperature and normal humidity (20°±5° C., 45±10%). Thereby, the following is confirmed: the optimum discharging current value in the case of the two-sided image forming mode, or the reverse side image forming mode, is larger than that in the case of the obverse side image forming mode; and further, the optimum discharging current value in the two-sided image forming mode is slightly larger than that in the case of the reverse side image forming mode. This is considered as follows: in the case of the two-sided image forming mode or the reverse side image forming mode, the toner image of the reverse side image is transferred by the reverse side transfer device 14g just before discharge of the recording sheet P by the paper separation AC discharger 14h, and thereby, the attraction of the recording sheet P to the toner image receiving body 14a is enhanced, so that the larger discharging current is necessary. The difference between the cases of the two-sided image forming mode and the reverse side image forming mode, is considered as follows: in the two-sided image forming mode, discharge for the toner image existing on the obverse side of the recording sheet P is necessary, so that the larger discharging current is necessary.

In order to obtain an excellent separation property in any of the cases of the obverse side image mode, the reverse side image mode, and the two-sided image forming mode, it is necessary to increase the discharging current value in the case of the reverse side image forming mode more than that in the case of the obverse side image forming mode, and to set the discharging current value in the case of the two-sided image forming mode larger than, or equal to, that in the case of the reverse side image forming mode. For example, the discharging current value to the paper separation AC discharger 14h, when the recording sheet P is discharged by the paper separation AC discharger 14h and is separated from the toner image receiving body 14a, is respectively changed in each of the cases of the obverse side image forming mode, reverse side image forming mode, and two-sided image forming mode, so that, as a discharging current value in the case of the obverse side image forming mode, for example, +500 V DC component is superimposed on an AC component of 5–7 kV$_{p-p}$, 150 μA; as a discharging current value in the case of the reverse side image forming mode, −500 V DC component is superimposed on an AC component of 5–7 kV$_{p-p}$, 200 μA; and as a discharging current value in the case of the two-sided image forming mode, −500 V DC component is superimposed on an AC component of 5–7 kV$_{p-p}$, 220 μA.

Figure 7:
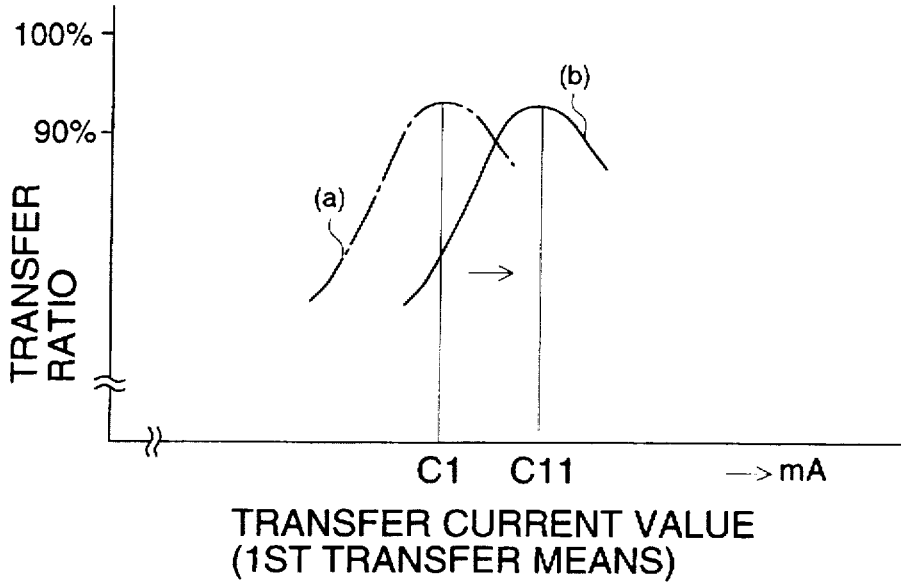
FIG. 7 is a view showing transfer characteristics when the toner image of the reverse side image, carried on the first image carrier, is transferred onto the second image carrier by the first transfer means, in two-sided image forming mode and reverse side image forming mode.
Figure 8:
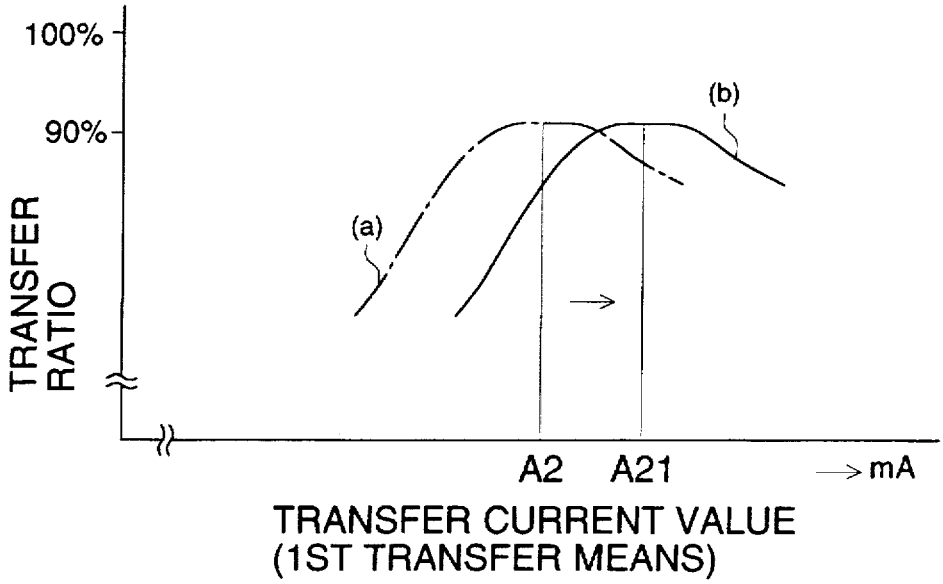
FIGS. 8(A) and 8(B) are views showing transfer characteristics in the two-sided image forming mode.
Figure 8:
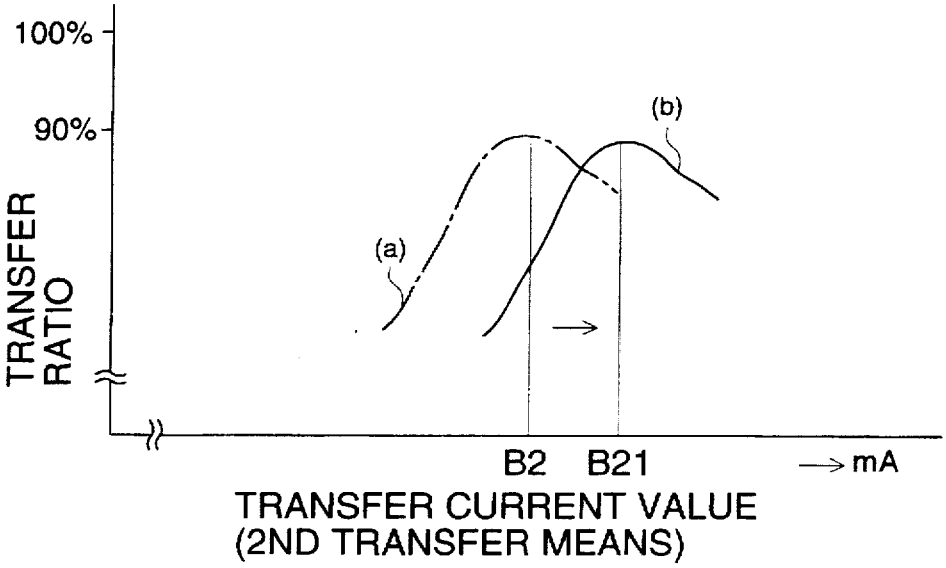
Figure 9:
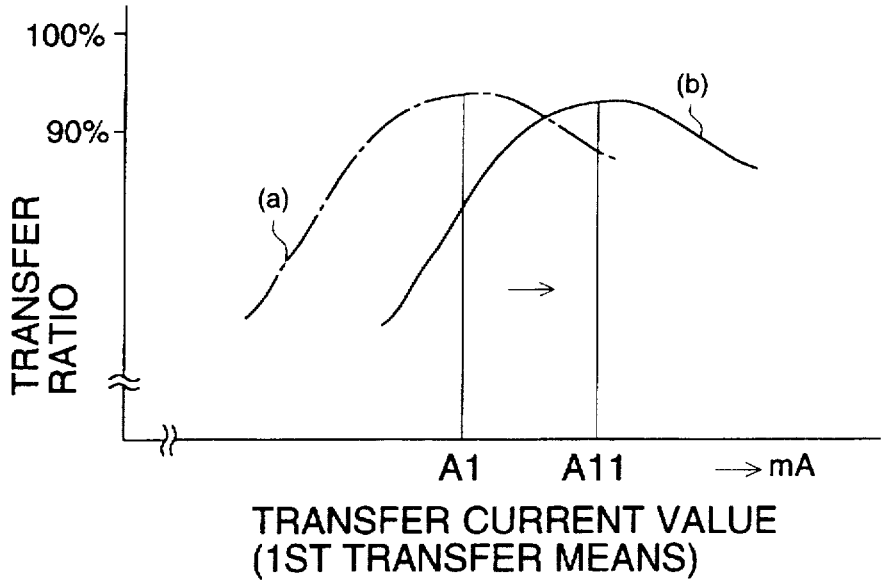
FIG. 9 is a view showing transfer characteristics when the toner image of the obverse side image, carried on the first image carrier, is transferred onto the obverse side of the transfer material by the first transfer means in the obverse side image forming mode.
Figure 10:
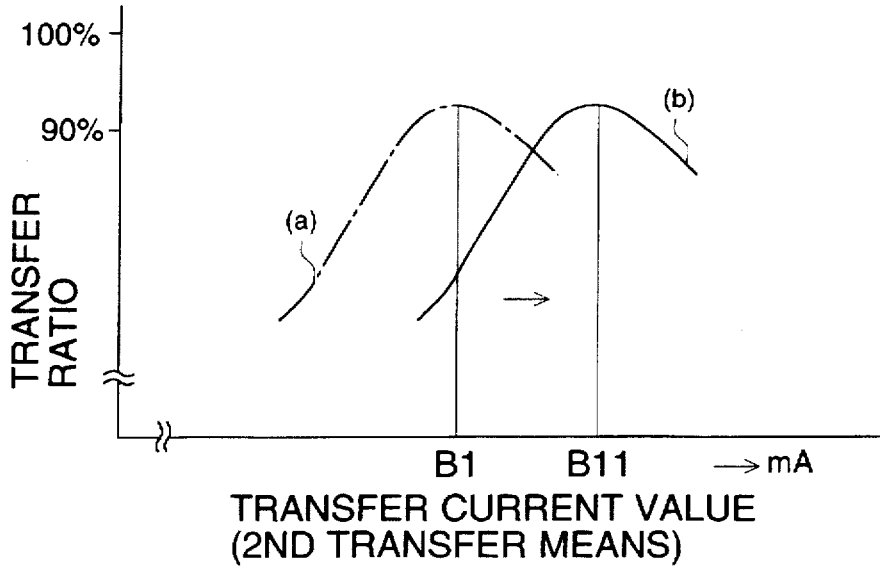
FIG. 10 is a view showing transfer characteristics when the toner image of the reverse side image, carried on the second image carrier, is transferred onto the reverse side of the transfer material by the second transfer means in the reverse side image forming mode.
Figure 11:
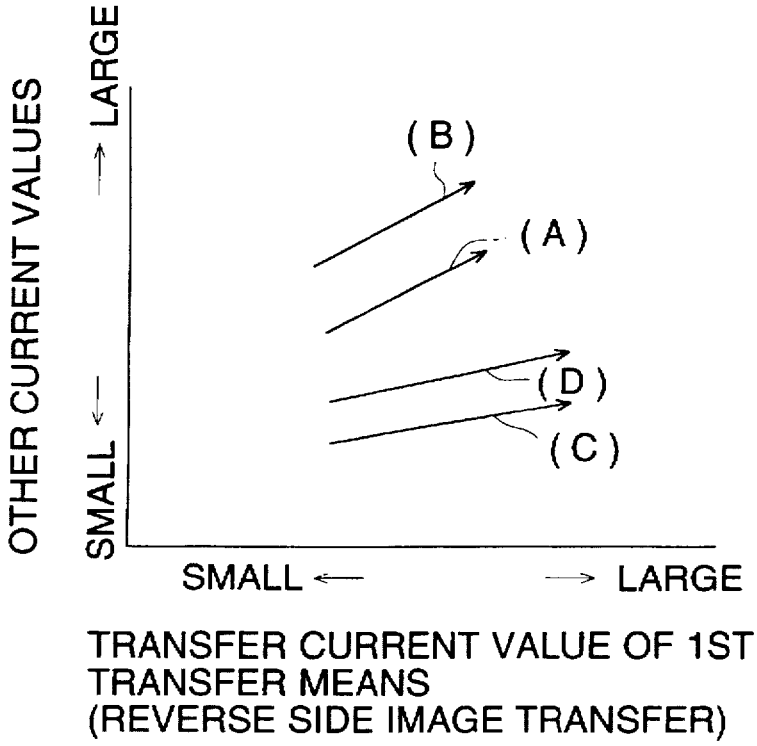
FIG. 11 is a view showing control operations in which the transfer current of the first transfer means, the transfer current of the second transfer means, the charging current of the transfer material charging means and the discharging current of the transfer material separation means are jointly correction-controlled in the two-sided image forming mode.

Next, referring to FIGS. 7 through 11 and FIG. 4, correction and control of the transfer current of the first transfer means, the transfer current of the second transfer means, the charging current of the transfer material charging means, and the transfer current of the discharging current of the transfer material separation means, will be described. FIG. 7 is a view showing the transfer characteristics when the toner image of the reverse side image carried on the first image carrier is transferred onto the second image carrier by the first transfer means, in the two-sided image forming mode and the reverse side image forming mode. FIGS. 8(A) and 8(B) are views showing the transfer characteristics in the two-sided image forming mode. FIG. 8(A) is a view showing the transfer characteristics when the toner image of the obverse side image carried on the first image carrier, is transferred onto the obverse side of the transfer material by the first transfer means. FIG. 8(B) is a view showing the transfer characteristics when the toner image of the reverse side image carried on the second image carrier, is transferred onto the reverse side of the transfer material by the second transfer means. FIG. 9 is a view showing the transfer characteristics when the toner image of the obverse side image carried on the first image carrier is transferred onto the obverse side of the transfer material by the first transfer means in the obverse side image forming mode. FIG. 10 is a view showing the transfer characteristics when the toner image of the reverse side image carried on the second image carrier is transferred onto the reverse side of the transfer material by the second transfer means, in the reverse side image forming mode. FIG. 11 is an illustration in which the transfer current (A) of the first transfer means, the transfer current (B) of the second transfer means, the charging current (C) of the transfer material charging means, and the discharging current (d) of the transfer material separation means, are linked together, corrected and controlled.

In FIG. 4, numeral 10 is a photoreceptor drum as the image carrier, numeral 14a is a toner image receiving body as the second image carrier, numeral 150 is a paper charger as the transfer material charging means, numeral 14c is a transfer device as the first transfer means, numeral 14g is a reverse side transfer device as the second transfer device, and numeral 14h is a paper separation AC discharger as the transfer material separation means. Numeral E1 is a DC constant current power source to supply a charging current to the paper charger 150, Numeral E2 is a DC constant current power source to supply a transfer current to the transfer device 14c, numeral E3 is a DC constant current power source to supply a transfer current to the reverse side transfer device 14g, and numeral E4 is an AC constant current power source to supply a discharging current to the paper separation AC discharger 14h. Numeral 160 is a humidity detection sensor as an environmental condition detection means inside the apparatus, and the paper charger 150 is also used as a transfer material thickness detection means, which is a detection means for types of transfer material.

As described in FIG. 1, in the present apparatus, the humidity detection sensor 160 to detect the humidity in the apparatus, as a sensor to detect the environmental condition in the apparatus (an environmental condition detection means), is provided at the position close to the photoreceptor drum 10 and the toner image receiving body 14a, and the humidity detection is carried out. In addition to the above, a temperature sensor may be provided as the environmental condition detection means, and the temperature detection may also be carried out.

Further, as a means to detect types of transfer material (a detection means for types of transfer material), for example, a thickness detection means for the recording sheet P is provided. In the present apparatus, the paper charger 150 is provided also as the thickness detection means for transfer material. When the recording sheet P is sent to the toner image receiving body 14a, the flowing current value at the leading edge portion of the recording sheet P is detected, and thereby, the thickness of the recording sheet P is detected.

When the image forming mode is selected by an operation section, not shown in the drawing, and respective image formation is carried out, an optimum current value, according to the image forming mode, humidity conditions, paper thickness conditions, or the like, which are previously obtained by experiments and stored in a ROM or RAM as a memory means, is read from the ROM or RAM through the control section, corresponding to the selected image forming mode, the humidity detection signal or transfer material thickness detection signal outputted from the humidity detection sensor or the thickness detection means for the transfer material, and correction of the transfer current value of the transfer device 14c by the DC constant current power source E2, the transfer current value of the reverse side transfer device 14g by the DC constant current power source E3, the charging current value of the paper charger 150 by the DC constant current power source E1, and the discharging current value of the paper separation AC discharger 14h by the AC constant current power source E4, is carried out.

FIG. 7 is a view showing transfer characteristics when the toner image of the reverse side image carried on the photoreceptor drum 10, is transferred onto the toner image receiving body 14a by the transfer device 14c as the first transfer means, in the two-sided image forming mode, and the reverse side image forming mode. The curve (a) shows the transfer characteristics under normal temperature and normal humidity environment (20°±5° C., 45±10%), and the curve (b) shows the transfer characteristics under high humidity environment of 60–80%. The optimum transfer current value under the normal temperature and normal humidity, is C1, and the transfer ratio is decreased when the humidity is 60–80%. Accordingly, when the environmental humidity is judged to be high by the humidity detection sensor 160, the optimum transfer current value C11 at high humidity, which are previously stored in the ROM or RAM, is read out, and the transfer current value to the transfer device 14c is corrected and controlled.

FIG. 8(A) is a view showing the transfer characteristics when the toner image of the obverse side image carried on the photoreceptor drum 10 is transferred onto the obverse side of the recording sheet P by the transfer device 14c as the first transfer means, in the two-sided image forming mode. The curve (a) is a case where a plain paper of 45–55 kg/m$^2$ paper thickness is used under the normal temperature and normal humidity (20°±5° C., 45±10%) environment. The curve (b) is a case where a thick paper of 60–75 kg/m$^2$ paper thickness is used under the high humidity environment of 60–80% humidity. The optimum transfer current value when a plain paper is used under the normal temperature and normal humidity, is A2, however, when a thick paper of 60–75 kg/m$^2$ paper thickness is used under the high humidity environment of 60–80% humidity, the transfer ratio is decreased. Therefore, when the transfer condition is judged such that the environment is highly humid and a thick paper is used, by the humidity detection signal of the humidity detection sensor 160, and the thickness detection signal for transfer material by the thickness detection means for the transfer material, the optimum transfer current value A21 in the case of high humidity and thick paper, which are previously stored in the ROM and RAM, is read, and thereby, the transfer current value to the transfer device 14c is corrected and controlled. In this connection, the correction and control of the transfer current value when both of the type of the transfer material and the environmental condition are changed, may be independently conducted corresponding to the type of transfer material or the environmental condition.

FIG. 8(B) is a view showing the transfer characteristics when the toner image of the reverse side image carried on the toner image receiving body 14a is transferred onto the reverse side of the recording sheet P by the reverse side transfer device 14g as the second transfer means, in the two-sided image forming mode. The curve (a) is a case where a plain paper of 45–55 kg/m$^2$ paper thickness is used under the normal temperature and normal humidity (20°±5° C., 45±10%) environment. The curve (b) is a case where a thick paper of 60–75 kg/m$^2$ paper thickness is used under the high humidity environment of 60–80% humidity. The optimum transfer current value when a plain paper is used under the normal temperature and normal humidity, is B2, however, when a thick paper of 60–75 kg/m$^2$ paper thickness is used under the high humidity environment of 60–80% humidity, the transfer ratio is decreased. Therefore, the optimum transfer current value B21 in the case of high humidity and thick paper, is read in the same manner as the above correction and control, and thereby, the transfer current value to the reverse side transfer device 14g is corrected and controlled.

FIG. 9 is a view showing the transfer characteristics when the toner image of the obverse side image carried on the photoreceptor drum 10 is transferred onto the obverse side of the recording sheet P by the transfer device 14c as the first transfer means, in the obverse side image forming mode. The curve (a) is a case where a plain paper of 45–55 kg/m$^2$ paper thickness is used under the normal temperature and normal humidity (20°±5° C., 45±10%) environment. The curve (b) is a case where a thick paper of 60–75 kg/m$^2$ paper thickness is used under the high humidity environment of 60–80% humidity. The optimum transfer current value when a plain paper is used under the normal temperature and normal humidity, is A1, however, when a thick paper of 60–75 kg/m$^2$ paper thickness is used under the high humidity environment of 60–80% humidity, the transfer ratio is decreased. Therefore, the optimum transfer current value A11 in the case of high humidity and thick paper, is read in the same manner as the above correction and control, and thereby, the transfer current value to the transfer device 14c is corrected and controlled.

FIG. 10 is a view showing the transfer characteristics when the toner image of the reverse side image carried on the toner image receiving body 14a is transferred onto the reverse side of the recording sheet P by the reverse side transfer device 14g as the second transfer means, in the reverse side image forming mode. The curve (a) is a case where a plain paper of 45–55 kg/m$^2$ paper thickness is used under the normal temperature and normal humidity (20°±5° C., 45±10%) environment. The curve (b) is a case where a thick paper of 60–75 kg/m$^2$ paper thickness is used under the high humidity environment of 60–80% humidity. The optimum transfer current value when a plain paper is used under the normal temperature and normal humidity, is B1, however, when a thick paper of 60–75 kg/m$^2$ paper thickness is used under the high humidity environment of 60–80% humidity, the transfer ratio is decreased. Therefore, the optimum transfer current value B11 in the case of high humidity and thick paper, is read in the same manner as the above correction and control, and thereby, the transfer current value to the reverse side transfer device 14g is corrected and controlled.

Due to the foregoing, in all cases of two-sided image forming mode, obverse side image forming mode, and reverse side image forming mode, transfer is finely performed even when there is a difference in types of transfer material, or there is a change in the environmental condition.

Further, in the same manner as described above, the charging current value to the paper charger 150 as the transfer material charging means, is corrected and controlled.

For example, when the 45–55 kg/m$^2$ thick plain paper is used under the normal temperature and normal humidity (20°±5° C., 45±10%) environment, the charging current value to the paper charger 150 is set to −70 μA, in the two-sided image forming mode, as described above, however, when the thick paper of 60–75 kg/m$^2$ thickness is used under the high humidity environment of 60–80%, the optimum charging current value for the case of high humidity and thick paper, is read, and the charging current value is set to −80 μA.

For example, when the 45–55 kg/m$^2$ thick plain paper is used under the normal temperature and normal humidity (20°±5° C., 45±10%) environment, the charging current value to the paper charger 150 is set to −50 μA, in the obverse side image forming mode, as described above, however, when the thick paper of 60–75 kg/m$^2$ thickness is used under the high humidity environment of 60–80%, the optimum charging current value for the case of high humidity and thick paper, is read, and the charging current value is set to −60 μA.

For example, when the 45–55 kg/m$^2$ thick plain paper is used under the normal temperature and normal humidity (20°±5° C., 45±10%) environment, the charging current value to the paper charger 150 is set to −75 μA, in the reverse side image forming mode, as described above, however, when the thick paper of 60–75 kg/m$^2$ thickness is used under the high humidity environment of 60–80%, the optimum charging current value for the case of high humidity and thick paper, is read, and the charging current value is set to −85 μA.

Due to the foregoing, in all cases of two-sided image forming mode, obverse side image forming mode, and reverse side image forming mode, charge and attraction of transfer material is finely performed even when there is a difference in types of transfer material, or there is a change in the environmental condition.

Further, in the same manner as described above, the discharging current value to the paper separation AC discharger **14*h*** as the transfer material separation means, is corrected and controlled.

For example, when the 45–55 kg/m$^2$ thick plain paper is used under the normal temperature and normal humidity (20°±5° C., 45±10%) environment, the discharging current value to the paper separation AC discharger **14*h*** is set to a value in which −500 V DC component is superimposed on the AC component of 5–7 kV$_{p-p}$, 220 μA, in the two-sided image forming mode, as described above. However, when the thick paper of 60–75 kg/m$^2$ thickness is used under the high humidity environment of 60–80%, the optimum discharging current value for the case of high humidity and thick paper, is read, and the discharging current value is set to a value in which −600 V DC component is superimposed on the AC component of 5–7 kV$_{p-p}$, 240 μA.

For example, when the 45–55 kg/m$^2$ thick plain paper is used under the normal temperature and normal humidity (20°±5° C., 45±10%) environment, the discharging current value to the paper separation AC discharger **14*h*** is set to a value in which +500 V DC component is superimposed on the AC component of 5–7 kV$_{p-p}$, 150 μA, in the obverse side image forming mode, as described above. However, when the thick paper of 60–75 kg/m$^2$ thickness is used under the high humidity environment of 60–80%, the optimum discharging current value for the case of high humidity and thick paper, is read, and the discharging current value is set to a value in which +600 V DC component is superimposed on the AC component of 5–7 kV$_{p-p}$, 180 μA.

For example, when the 45–55 kg/m$^2$ thick plain paper is used under the normal temperature and normal humidity (20°±5° C., 45±10%) environment, the discharging current value to the paper separation AC discharger **14*h*** is set to a value in which −500 V DC component is superimposed on the AC component of 5–7 kV$_{p-p}$, 200 μA, in the reverse side image forming mode, as described above. However, when the thick paper of 60–75 kg/m$^2$ thickness is used under the high humidity environment of 60–80%, the optimum discharging current value for the case of high humidity and thick paper, is read, and the discharging current value is set to a value in which −600 V DC component is superimposed on the AC component of 5–7 kV$_{p-p}$, 220 μA.

Due to the foregoing, in all cases of two-sided image forming mode, obverse side image forming mode, and reverse side image forming mode, separation of transfer material is finely performed even when there is a difference in types of transfer material, or there is a change in the environmental condition.

In the present invention, at least two of the following corrections are jointly performed: correction of the transfer current value of the transfer device **14*c* as the first transfer means when the toner image of the reverse side image carried on the photoreceptor drum 10 is transferred onto the toner image receiving body 14*a*; correction of the transfer current value of the transfer device 14*c* as the first transfer means when the toner image of the obverse side image carried on the photoreceptor drum 10 is transferred onto the obverse side of the recording sheet P; correction of the transfer current value of the reverse side transfer device 14*g* as the second transfer means when the toner image of the reverse side image carried on the toner image receiving body 14*a* is transferred onto the reverse side of the recording sheet P; correction of the charging current value to the paper charger 150 as the transfer material charging means when the recording sheet p is supplied to the toner image receiving body 14*a*; and correction of the discharging current to the paper separation AC discharger 14*h* as the transfer material separation means when the recording sheet P is separated from the toner image receiving body 14*a*, in each of the two-sided image forming mode, the obverse side image forming mode, and the reverse side image forming mode, as described in FIGS. 7 through 10**, corresponding to variations in the type of transfer material or the environmental condition.

That is, in the case of two-sided image forming mode, at least two of the following values are jointly changed: the transfer current value of the transfer device **14*c* as the first transfer means by which the toner image of the reverse side image on the photoreceptor drum 10 is transferred onto the toner image receiving body 14*a*; the transfer current value of the transfer device 14*c* as the first transfer means by which the obverse side image on the photoreceptor drum 10 is transferred onto the obverse side of the recording sheet P; the transfer current value of the reverse side transfer device 14*g* as the second transfer means by which the reverse side image on the toner image receiving body 14*a* is transferred onto the reverse side of the recording sheet P; the charging current value to the paper charger 150 as the transfer material charging means; and the discharging current value to the paper separation AC discharger 14*h* as the transfer material separation means. In the obverse side image forming mode, at least two of the following values are jointly changed: the transfer current value of the transfer device 14*c* as the first transfer means by which the obverse side image on the photoreceptor drum 10 is transferred onto the obverse side of the recording sheet P; the charging current value to the paper charger 150 as the transfer material charging means; and the discharging current value to the paper separation AC discharger 14*h* as the transfer material separation means. In the reverse side image forming mode, at least two of the following values are jointly changed: the transfer current value of the transfer device 14*c* as the first transfer means by which the reverse side image on the photoreceptor drum 10 is transferred onto the toner image receiving body 14*a*; the transfer current value of the reverse side transfer device 14*g* as the second transfer means by which the reverse side image on the toner image receiving body 14*a* is transferred onto the reverse side of the recording sheet P; the charging current value to the paper charger 150 as the transfer material charging means; and the discharging current value to the paper separation AC discharger 14*h***.

When the correction is jointly carried out, the following values which are intertwining with each other depending on the image forming mode, can be respectively set to the optimum condition: the transfer current value of the transfer device **14*c* as the first transfer means, the transfer current value of the reverse side transfer device 14*g* as the second transfer means, the charging current value of the paper charger 150 as the transfer material charging means, and the discharging current value of the paper separation AC discharger 14*h*** as the transfer material separation means. When each correction is independently carried out, the optimum setting range for each current value has the maximum value, and therefore, there are cases where the current value is set too large, or the increased amount of the current value is set too small. Accordingly, each value can not always be set to the optimum value, but also the correction and control become very complicated.

For example, as shown in FIG. 11, in the two-sided image forming mode, when the transfer current value to the transfer device **14*c* as the first transfer means, by which the toner image of the reverse side image carried on the photoreceptor drum 10 is transferred onto the toner image receiving body 14*a*, is corrected corresponding to types of the transfer material or a change in the environmental condition, the following corrections are jointly carried out: correction of transfer current value to the transfer device 14*c* as the first transfer means by which the toner image of the obverse side image carried on the photoreceptor drum 10, is transferred onto the obverse side of the recording sheet P; correction of the transfer current value to the reverse side transfer device 14*g* as the second transfer means by which the toner image of the reverse side image carried on the toner image receiving body 14*a*, is transferred onto the reverse side of the recording sheet P; correction of the charging current value to the paper charger 150 as the transfer material charging means when the recording sheet P is supplied to the toner image receiving body 14*a*; and correction of the discharging current to the paper separation AC discharger 14*h* as the transfer material separation means when the recording sheet P is separated from the toner image receiving body 14*a***.

That is, in the two-sided image forming mode, when the transfer current value of the transfer device **14*c* as the first transfer means, by which the reverse side image on the photoreceptor drum 10 is transferred onto the toner image receiving body 14*a*, is increased, the transfer current value of the transfer device 14*c* as the first transfer means, by which the obverse side image on the photoreceptor drum 10 is transferred onto the obverse side of the recording sheet P, and the transfer current value of the reverse side transfer device 14*g* as the second transfer means, are also increased. Further, when the transfer current value of the transfer device 14*c*, by which the obverse surface image on the photoreceptor drum 10 is transferred onto the obverse side of the recording sheet P, is increased, the transfer current value of the reverse side transfer device 14*g*, and the discharge current value of the paper separation AC discharger 14*h* as the transfer material separation means, are also increased. Still further, when the transfer current value of the reverse side transfer device 14*g* is increased, the discharging current value of the paper separation AC discharger 14*h* is also increased. Furthermore, when the charging current value of the paper charger 150 as the transfer material charging means is increased, the transfer current value of the transfer device 14*c*, by which the obverse side image on the photoreceptor drum 10 is transferred onto the obverse side of the recording sheet P, the transfer current value of the reverse side transfer device 14*g*, and the discharging current value of the paper separation AC discharger 14*h***, are also increased.

Yet further, in the obverse side image forming mode, when the transfer current value of the transfer device **14*c*, by which the obverse side image on the photoreceptor drum 10 is transferred onto the obverse side of the recording sheet P, is increased, the discharging current value of the paper separation AC discharger 14*h* is also increased, and when the charging current value of the paper charger 150 is increased, the transfer current value of the transfer device 14*c*, by which the obverse side image on the photoreceptor drum 10 is transferred onto the obverse side of the recording sheet P, and the discharging current value of the paper separation AC discharger 14*h***, are also increased.

Furthermore, in the reverse side image forming mode, when the transfer current value of the transfer device **14*c*, by which the reverse side image on the photoreceptor drum 10 is transferred onto the toner image receiving body 14*a*, is increased, the transfer current value of the reverse side transfer device 14*g* is also increased; when the transfer current value of the reverse side transfer device 14*g* is increased, the discharging current value of the paper separation AC discharger 14*h* is also increased; and when the charging current value of the paper charger 150 is increased, the transfer current value of the reverse side transfer device 14*g*, and the discharging current value of the paper separation AC discharger 14*h*** are also increased.

As described above, when the transfer current value of the first transfer means, the transfer current value of the second transfer means, the charging current value of the transfer material charging means, and the discharging current value of the transfer material separation means, are jointly corrected and controlled, transfer of the toner image, charge and attraction of transfer material, and separation of the transfer material are finely performed even when there is a difference in types of transfer material, or there is a change in the environmental condition, in all cases of two-sided image forming mode, obverse side image forming mode, and reverse side image forming mode.

In the above description, the constant current power source is used for correction and control of the transfer current value of the first transfer means, the transfer current value of the second transfer means, the charging current value of the transfer material charging means, and the discharging current value of the transfer material separation means. However, of course, the constant voltage power source may be used for correction and control of the transfer voltage value of the first transfer means, the transfer voltage value of the second transfer means, the charging voltage value of the transfer material charging means, and discharging voltage value of the transfer material separation means.

EXAMPLE 2

Figure 12:
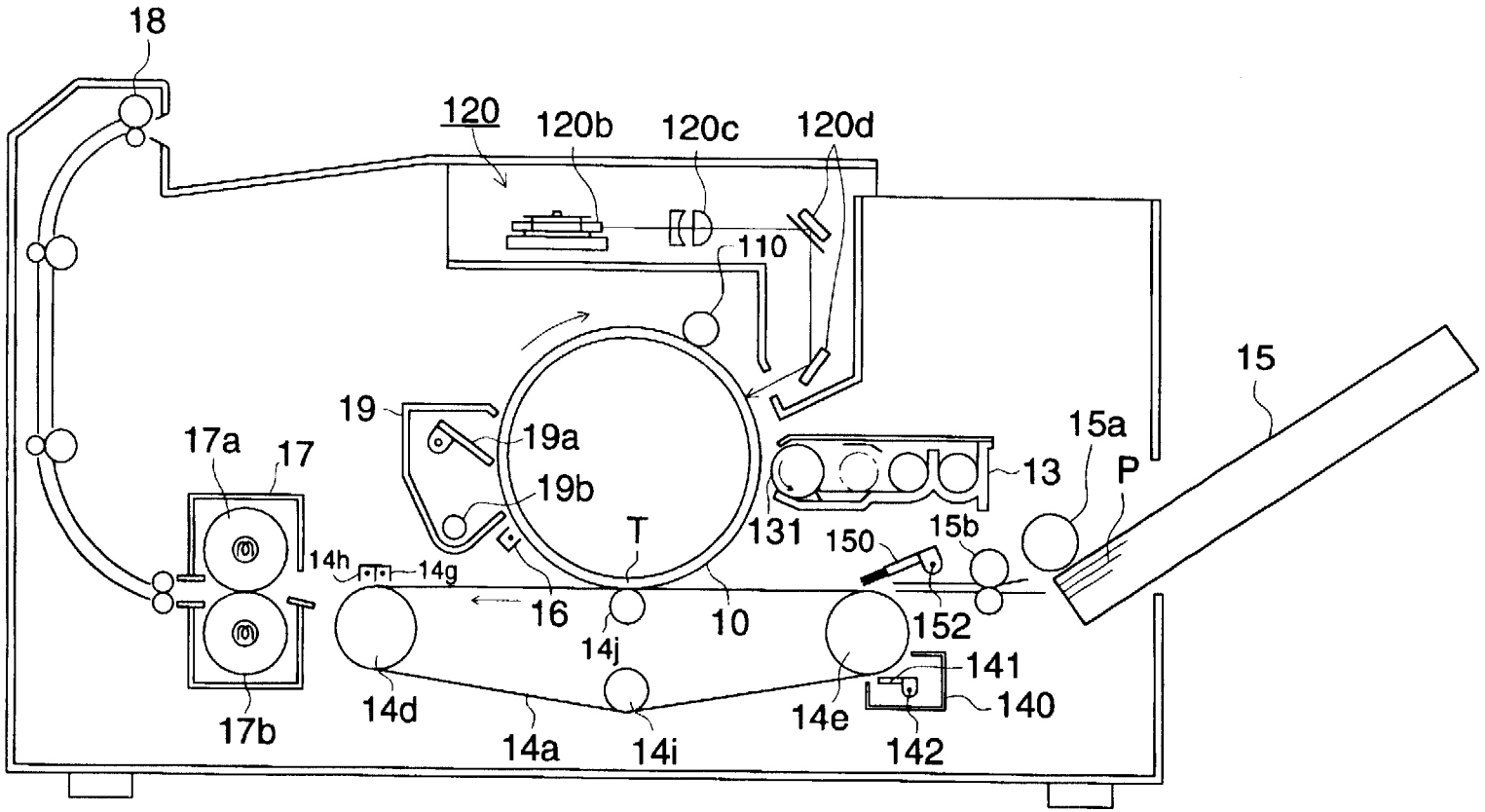
FIG. 12 is a sectional view showing the structure of an image forming apparatus of the second example of an image forming apparatus of the present invention.

Referring to FIG. 12 and FIGS. 13(A) through 13(O), image forming processes and each mechanism of the second example of the image forming apparatus according to the present invention, will be described below. FIG. 12 is a structural sectional view of an image forming apparatus of the second example of the image forming apparatus according to the present invention. FIGS. 13(A) through 13(O) are timing charts of image forming processes of the second example. The present example relates to a monochromatic image formation, instead of the color image formation of the first example, and members having the same function and structure as those described in the image forming apparatus of the first example, are denoted by the same numbers.

The charging means and the first transfer means of the image forming apparatus of the first example are changed, and substitute devices are used for the image forming apparatus of the present example.

As the charging means, a roller charger 110, which is a contact charging member, is used instead of the scorotron charger 11, and charging bias voltage, in which AC voltage is superimposed on DC voltage, is applied onto the roller charger 110, and thereby, the photoreceptor drum 10 is charged.

As the first transfer means, a transfer roller 14*j*, which is a contact transfer member, is used instead of the transfer device 14*c* composed of the corona discharger; the transfer roller 14*j* is brought into contact with the photoreceptor drum 10 through the toner image receiving body 14*a*, and a nip portion (transfer area) T is formed; transfer bias voltage (DC voltage) with the reverse polarity as the toner (in the present example, positive polarity) is applied on the transfer roller 14*j*, and thereby, a transfer electric field is formed in the nip portion T; and the toner image on the photoreceptor drum 10 is transferred onto the toner image receiving body 14*a* and the obverse side of the recording sheet P.

In the same manner as Example 1, as a sensor to measure the environmental condition in the apparatus, for example, a humidity sensor 160 to detect the humidity in the apparatus is provided at a position close to the photoreceptor drum 10 and the toner image receiving body 14*a*. As a sensor to measure the environmental condition in the apparatus, a temperature sensor, or similar sensors may be provided other than the above sensor.

Image forming processes of the image forming apparatus of the second example, will be described below.

The photoreceptor drum 10 as the first image carrier, is formed such that a photoreceptor layer such as a a-Si (amorphous silicon) or organic photoreceptor layer (OPC), is formed on the outer periphery of the substrate formed of, for example, cylindrical aluminum member, and is rotated clockwise as shown by an arrow in FIG. 12 at the peripheral speed of 280 mm/sec.

The roller charger 110 as the charging means, is a charging member in contact with the photoreceptor drum 10, and charges (in the present example, negative charging) the photoreceptor layer of the photoreceptor drum 10 by a charging bias voltage with the same polarity of the toner (in the present example, negative polarity), applied on the roller charger 110, so that a uniform potential voltage is applied on the photoreceptor drum 10.

An exposure unit 120 as an image exposure means, is composed of a semiconductor laser as a light emitting element, not shown, a rotating polygonal mirror 120*b* which rotationally scans an image using laser beams emitted from the semiconductor laser, an f θ lens 120*c*, and a reflection mirror 120*d*, and the rotating polygonal mirror 120*b* rotationally scans an image using laser beams emitted from the semiconductor laser, imagewise-exposures on the rotating photoreceptor drum 10 according to image data, through the f θ lens 120*c* and the reflection mirror 120*d*, so that a latent image is formed. In this connection, it is necessary to change image data so that image data corresponding to the obverse side image, and image data corresponding to the reverse side image form a mirror image with respect to each other.

A developing device 13 as a developing means stores one component or two component developer of, for example, black (K), and is provided with a developing sleeve 131 which is a developer carrier and is formed of 0.5–1 mm thick, 15–25 mm outer diameter cylindrical non-magnetic stainless or aluminum material, and which has a predetermined gap with respect to the photoreceptor drum 10 by a roller, not shown in the drawings. DC developing bias voltage having the same polarity as toner (in the present example, negative polarity) is applied on the developing sleeve 131, reversal development is conducted, and a latent image on the photoreceptor drum 10 is developed. As the developing bias voltage, voltage in which AC voltage is superimposed on DC voltage, may also be used.

In the present example, a roller charger 110, an exposure unit 120 and a developing device 13 are arranged in order from the upstream side in the moving direction of the photoreceptor drum 10. When image recording is started, the photoreceptor drum 10 is rotated clockwise shown by an arrow in the drawing by a photoreceptor driving motor, not shown, and simultaneously the roller charger 110 is operated so that application of a potential voltage on the photoreceptor drum 10 is started. Next, image exposure by laser beams is carried out on the photoreceptor drum 10 on which the potential voltage is applied, by the exposure unit 120, and an electrostatic latent image is formed on the photoreceptor drum 10. The electrostatic latent image is reversal-developed, and a toner image is formed on the photoreceptor drum 10 (a toner image forming means).

By the above image forming processes, the toner image of the reverse side image is formed on the photoreceptor drum 10 as the first image carrier, and is transferred onto the toner image receiving body 14*a* as the second image carrier, in the transfer area T, by a transfer roller 14*j* as the first transfer means on which DC voltage with the reverse polarity to the toner (in the present example, positive polarity) is applied.

The toner image receiving body 14*a* as the second image carrier, is an endless belt trained around a dive roller 14*d*, a driven roller 14*e* and a tension roller 14*i*, and is in contact with the photoreceptor drum 10. The belt is a film belt of 2 layer construction in which, for example, 5–50 μm thick semi-conductive fluorine coating, preferably as a toner filming prevention layer, is conducted outside the semiconductive modified polyimide belt substrate, which is 100–500 μm thick and has $10^{10}$–$10^{14}$ Ω.cm volume resistivity. Instead of the modified polyimide substrate, a film of semiconductive polyester, polystyrene, polyethylene, polyethylene terephthalate, ETFE (ethylene-tetrafluoro ethylene copolymer), etc. of 100–500 μm thickness and $10^{10}$–$10^{14}$ Ω.cm volume resistivity, or semiconductive urethane rubber or silicon rubber of 0.5–2.0 mm thickness, and $10^{10}$–$10^{14}$ Ω.cm volume resistivity, may be used as the substrate.

Toner remaining on the peripheral surface of the photoreceptor drum 10 after transfer, is discharged by a photoreceptor drum AC discharger 16, and after that, moved to a cleaning device 19 as a photoreceptor drum cleaning means, cleaned by a cleaning blade 19*a* formed of rubber material in contact with the photoreceptor drum 10, and is collected into a waste toner container, not shown, by a screw 19*b*.

Due to the foregoing, after the toner image, which will be a reverse side image, has been formed on the toner image receiving body 14*a*, serving as the second image carrier, the toner image, which will be an obverse side image, is successively formed on the photoreceptor drum 10, serving as the first image carrier, from which residual toner has been removed.

The recording sheet P, which is a transfer material, is fed from a sheet feed cassette 15, which is a transfer material accommodation means, by a timing roller 15*b* through a feed roller 15*a*. In this case, feeding of the recording sheet P is in timed relationship with the obverse side image formation so that the recording sheet P is synchronized with the toner image of the reverse side image formed on the toner image receiving body 14*a*, and the toner image of the obverse side image formed on the photoreceptor drum 10, in the transfer area.

The recording sheet P, fed in timed relationship with the image formation by the timing roller 15*b*, is paper-charged to the same polarity as the toner by a brush-like paper charger 150 as the transfer material charging means, on which a DC voltage with the same polarity as the toner (in the present example, negative polarity) is applied, and is attracted to the toner image receiving body 14*a*.

A paper charger 150 as the transfer material charging means, is a conductive brush which is rotatable around a support shaft 152, and can be in contact with and contact-released from the toner image receiving body 14*a*, and is arranged opposite to the grounded driven roller 14*e*. The paper charger 150 is in contact with the toner image receiving body only during passage of the recording sheet P, and DC voltage with the same polarity as the toner is applied on the paper charger 150. Just before the passage of the trailing edge of the recording sheet P or simultaneously with the passage, the paper charger 150 is released from the contact with the toner image receiving body 14*a*, separated from the recording sheet P, and application of the voltage is stopped.

The polarity of paper-charging by the paper-charger 150 is the same as toner, and the recording sheet p is prevented from being attracted to the toner image on the toner image receiving body 14*a*, or the toner image on the photoreceptor drum 10, thereby, the toner image is prevented from being disturbed. As the transfer material charging means, a conductive roller, which can be in contact with and contact-released from the toner image receiving body 14*a*, and on which DC voltage with the same polarity as toner is applied, may also be used other than the above described paper charger.

The recording sheet P attracted to the toner image receiving body 14*a* by the paper charger 150, is sent to the transfer area T. In the transfer area T, the toner image of the obverse side image on the photoreceptor drum 10 is transferred onto the obverse side (upper surface side) of the recording sheet P, by the transfer roller 14*j* as the first transfer means, on which voltage with the reverse polarity to the toner (in the present example, positive polarity) is applied. In this connection, the toner image of the reverse side image on the toner image receiving body 14*a* is not transferred onto the recording sheet P, but remains on the toner image receiving body 14*a*.

The recording sheet P, onto which the toner image of the obverse side image has been transferred, is conveyed to the second transfer area by the movement of the toner image receiving body 14*a* while being attracted to the toner image receiving body 14*a*. In the second transfer area, the toner image of the reverse side image on the toner image receiving body 14*a* is transferred onto the reverse side (lower surface side) of the recording sheet P by the reverse side transfer device 14*g*, serving as the second transfer means, which is arranged opposite to the grounded driving roller 14*d*, and on which voltage with the reverse polarity to the toner (in the present example, positive polarity) is applied.

The recording sheet P, on both sides of which the toner images have been transferred as described above, is discharged by the paper separation AC discharger 14*h* as the transfer material separation means, which is arranged opposite to the grounded driving roller 14*d*, and on which AC voltage or superimposed voltage of AC and DC voltage is applied, and is separated from the toner image receiving body 14*a*.

The recording sheet P separated from the toner image receiving body 14*a*, is sent to a fixing device 17 as a fixing means, having two rollers 17*a* and 17*b*, each of which houses a heater. After toner, adhered onto the obverse and reverse sides of the recording sheet P, has been fixed by heat and pressure, the recording sheet P is delivered onto a tray provided outside the apparatus through a discharging roller 18.

Toner, remaining on the toner image receiving body 14*a* after the toner image of the reverse side image has been transferred onto the recording sheet P, is cleaned by a toner image receiving body cleaning device 140, which is the second image carrier cleaning means provided opposite to the driven roller 14*e* and having a blade member 141, which can be rotated around the support shaft 142 and can be in contact with and contact-released from the toner image receiving body 14*a*. In this connection, the contact-release and contact operation of the blade member 141 is carried out by ON/OFF operation of a contact release solenoid, not shown in the drawing.

The toner remaining on the photoreceptor drum 10 after the toner image of the obverse side image has been transferred onto the recording sheet P, is discharged by a photoreceptor drum AC discharger 16 in the same manner as in the case of reverse side image formation. After that, the residual toner is removed by a cleaning device 19, and the photoreceptor drum 10 enters the next image information cycle.

In the above image forming apparatus, images are formed on two sides of the recording sheet P as described above, however, of course, an image can be formed on only the obverse side or reverse side of the recording sheet P, as described in FIGS. 3(A) and 3(B) of Example 1.

FIGS. 13(A) through 13(O) are timing charts of image forming processes according to the present example, when two sided images are formed on a size A-3 sheet. In the drawing, a laser output 1 shows laser exposure scanning from an exposure unit 120 to the photoreceptor drum 10 in the case of reverse side image formation, and a laser output 2 shows laser exposure scanning from the exposure unit 120 to the photoreceptor drum 10 in the case of obverse side image formation. A transfer roller high tension output 1 shows transfer voltage application onto the transfer roller 14*j* as the first transfer means when the reverse side image on the photoreceptor drum 10 is transferred onto the toner image receiving body 14*a*, and a transfer high tension output 2 shows transfer voltage application onto the transfer roller 14*j* when the obverse side image on the photoreceptor drum 10 is transferred onto the obverse side of the recording sheet P. A reverse side transfer device high tension output shows transfer voltage application onto the reverse transfer device 14*g* when the toner image of the reverse side image on the toner image receiving body 14*a* is transferred onto the reverse side of the recording sheet P. A paper charger high tension output shows charging voltage application onto the paper charger 150 when the recording sheet P is charged and attracted to the toner image receiving body 14*a*. A paper separation AC discharger high tension output shows discharging voltage application onto the paper separation AC discharger 14*h* when the recording sheet P is separated from the toner image receiving body 14*a*.

In the present invention, transfer voltage application onto the transfer roller 14*j*, transfer voltage application onto the reverse side transfer device 14*g*, charging voltage application onto the paper charger 150, and discharging voltage application onto the paper separation AC discharger, are conducted using the constant voltage power source, and transfer voltage of the transfer roller 14*j*, transfer voltage of the reverse side transfer device 14*g*, charging voltage of the paper charger 150, and discharging voltage of the paper separation AC discharger 14*h* are controlled. However, in also the present example, of course, transfer current of the transfer roller 14*j*, transfer current of the reverse side transfer device 14*g*, charging current of the paper charger 150, and discharging current of the paper separation AC discharger 14*h* may be controlled by using the constant current power source in the same manner as in Example 1.

Figure 14:
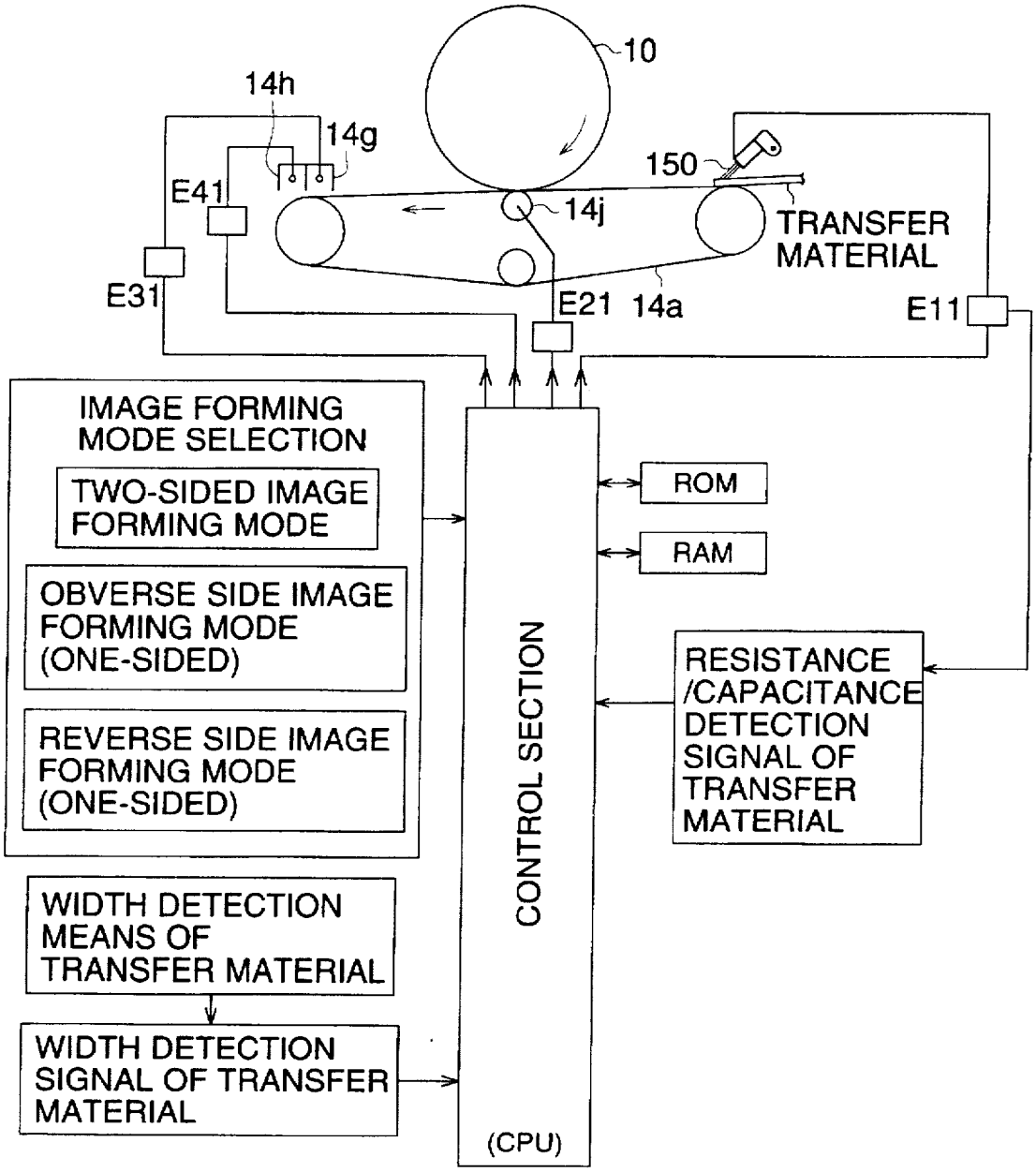
FIG. 14 is a block diagram showing the control of transfer voltage of the first transfer means, transfer voltage of the second transfer means, charging voltage of the transfer material charging means, and discharging voltage of the transfer material separation means, corresponding to a detection result by a transfer material resistance/capacitance detection means.

Next, referring to FIG. 14 and FIGS. 13(A) through 13(O), control of transfer voltage of the first transfer means, transfer voltage of the second transfer means, charging voltage of the transfer material charging means, and discharging voltage of the transfer material separation means, corresponding to the result of detection by a transfer material resistance/capacitance detection means, will be explained. FIG. 14 is a block diagram showing the control of transfer voltage of the first transfer means, transfer voltage of the second transfer means, charging voltage of the transfer material charging means, and discharging voltage of the transfer material separation means, corresponding to the result of detection by a transfer material resistance/capacitance detection means.

In the present apparatus, the paper charger 150 as the transfer material charging means is used also for the transfer material resistance/capacitance detection means to detect resistance or capacitance of the transfer material, or both of resistance and capacitance of the transfer material, by a method in which voltage is applied on the transfer material, and the current value at the time is detected, or a current is caused to flow through the transfer material, and the applied voltage value at the time is detected. The transfer material resistance/capacitance detection is carried out, for example, as shown in FIGS. 13(A) through 13(O), such that, when the paper charger 150 charges the recording sheet P as the transfer material, the current value from a DC constant voltage power source E11 is detected at the leading edge portion of the recording sheet P, for example, within a range of 1–5 mm of the leading edge portion of the recording sheet P. Then, a transfer material resistance/capacitance detection signal is inputted into the control section.

The resistance/capacitance of the transfer material changes depending on the thickness or material of the transfer material, or environmental conditions in the apparatus, etc. Even if the resistance/capacitance of the transfer material itself is not changed when the width of the transfer material is changed, the width in which the paper charger 150 is in contact with the toner image receiving body 14*a* at both end portions of the transfer material, is changed, and therefore, the transfer material resistance/capacitance detection signal from the paper charger 150 changes. Accordingly, in the present apparatus, as a means to detect the width of the transfer material in the conveyance direction of the transfer material (transfer material width detection means), a transfer material size detection member, not shown, is provided, for example, in the sheet feed cassette 15 which is a transfer material accommodation means, and a transfer material width detection signal is inputted into the control section from the transfer material size detection member as the transfer material width detection means.

When the image forming mode is selected by the operation section, not shown, and each image formation is conducted, the image formation mode, and the optimum current value according to changes of resistance/capacitance, which are previously obtained in experiments, and stored in the ROM, RAM as the memory means, are read from the ROM or RAM through the control section, corresponding to the selected image forming mode, the transfer material resistance/capacitance detection signal, or a transfer material width detection signal, and thereby, the correction for the following voltage values is conducted: the transfer voltage value of the transfer roller 14*j* by the DC constant voltage power source E21, the transfer voltage value of the reverse side transfer device 14*g* by the DC constant voltage power source E31, the charging voltage value of the paper charger 150 by the DC constant voltage power source E11, and the discharging voltage value of the paper separation AC discharger 14*h* by the AC constant voltage power source E41. Incidentally, in the above description, the paper discharger 150 is used also for the paper charger transfer material resistance/capacitance detection means, and therefore, the correction of the charging voltage value of the paper charger 150 as the transfer material charging means, is conducted from the portion following the leading edge portion of the transfer material after the leading edge portion of the transfer material has passed.

Due to the foregoing, even when the resistance/capacitance of the transfer material changes due to the thickness or material of the transfer material, or environmental conditions in the apparatus, transfer of the toner image, charge and attraction of the transfer material, or separation of the transfer material can be finely conducted.

Figure 15:
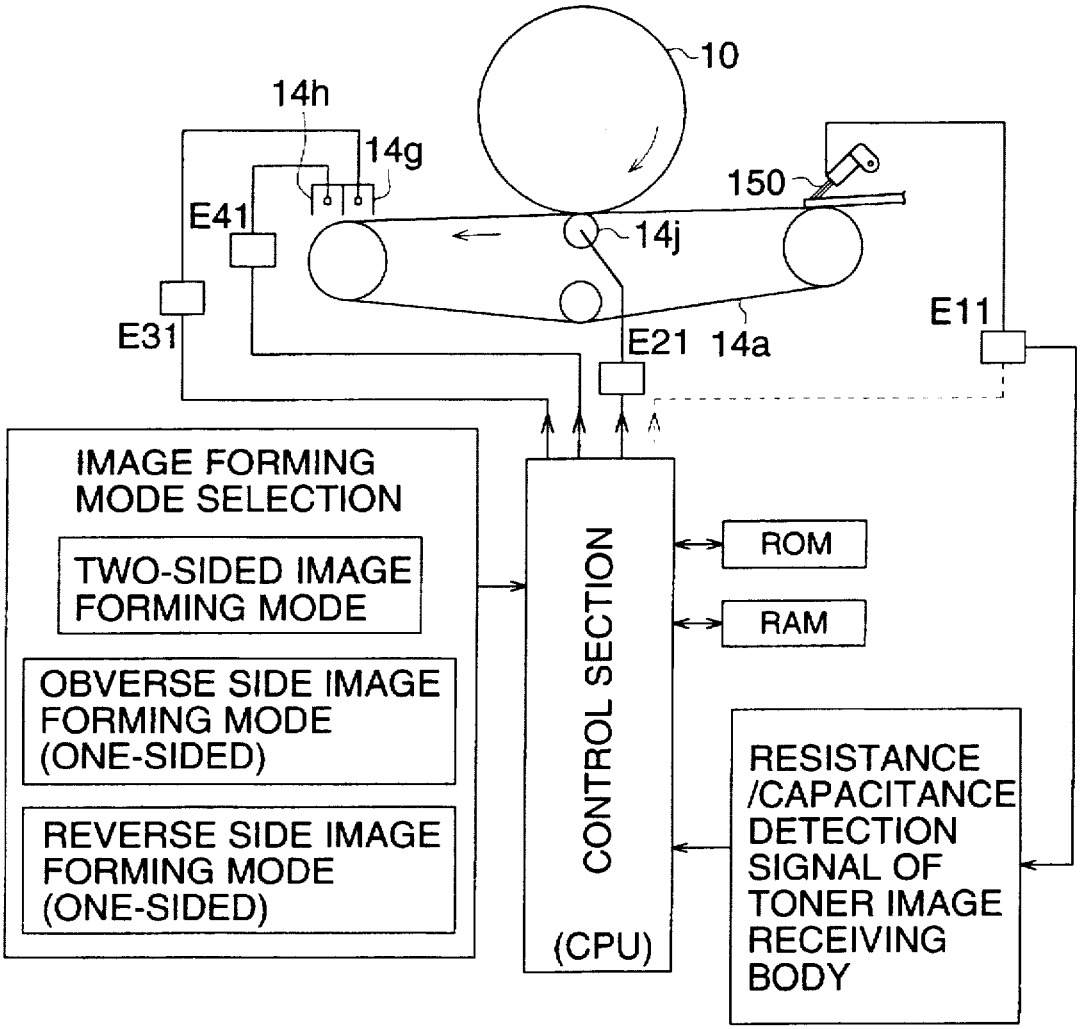
FIG. 15 is a block diagram of a current control circuit, showing an example in which the transfer material charging means is used as the second image carrier resistance/capacitance detection means.
Figure 16:
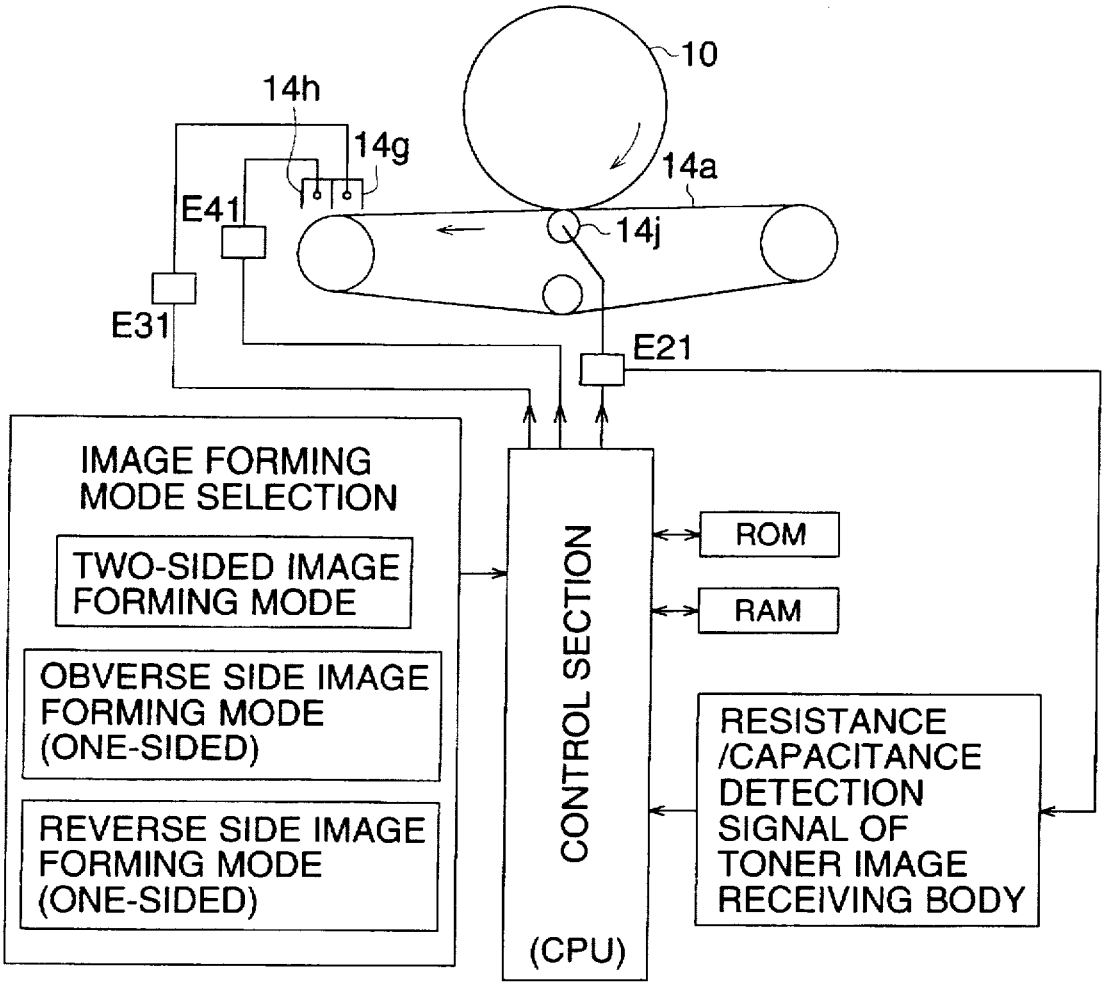
FIG. 16 is a block diagram of the current control circuit, showing an example in which the first transfer means is used as the second image carrier resistance/capacitance detection means.
Figure 17:
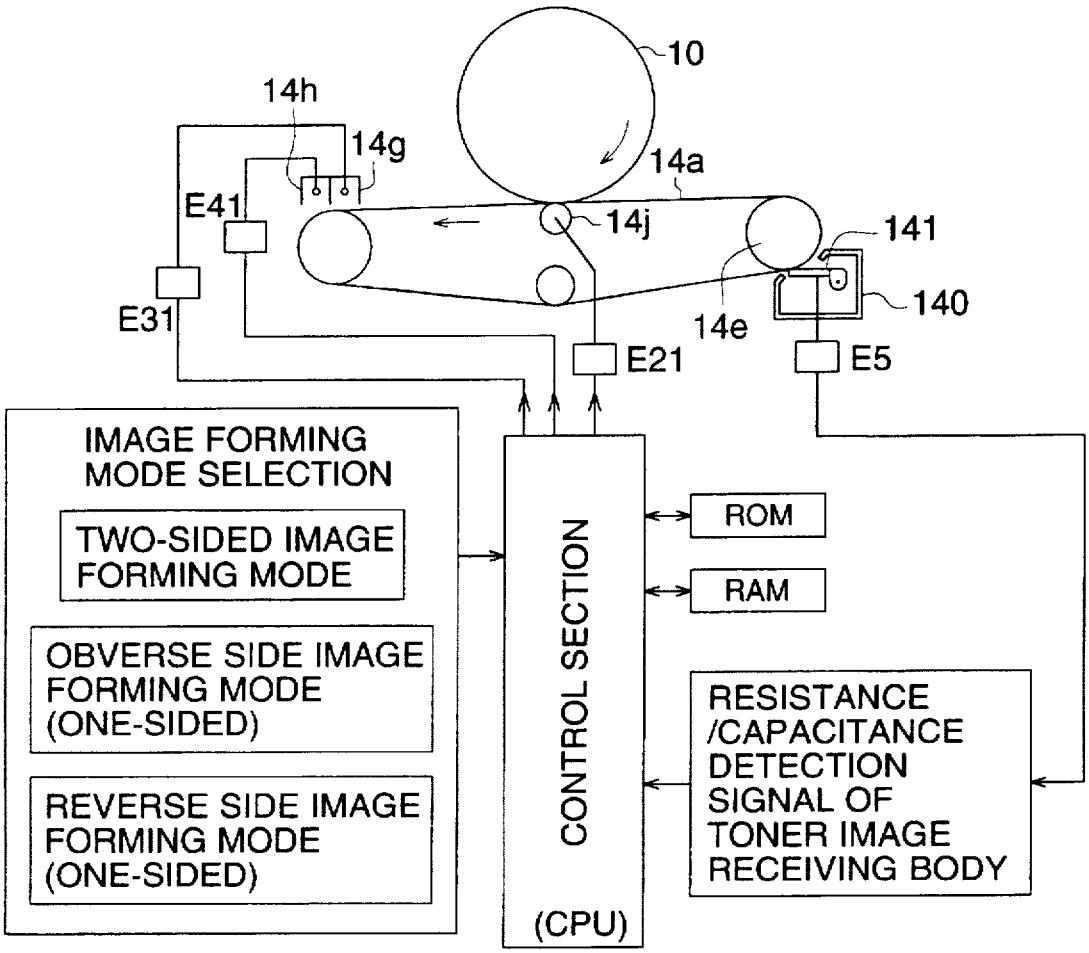
FIG. 17 is a block diagram of the current control circuit, showing an example in which the second image carrier cleaning means is used as the second image carrier resistance/capacitance detection means.

Next, referring to FIGS. 15 through 17, and FIGS. 13(A) through 13(O), the control of the transfer voltage of the first transfer means, the transfer voltage of the second transfer means, the charging voltage of the transfer material charging means, and the discharging voltage of the transfer material separation means, corresponding to the detection result by the second image carrier resistance/capacitance detection means, will be explained. FIG. 15 is a circuit block diagram of current control, showing an example in which the transfer material charging means is used as the second image carrier resistance/capacitance detection means. FIG. 16 is a circuit block diagram of current control, showing an example in which the first transfer means is used as the second image carrier resistance/capacitance detection means. FIG. 17 is a circuit block diagram of current control, showing an example in which the second image carrier cleaning means is used as the second image carrier resistance/capacitance detection means.

FIG. 15 is a block diagram when the paper charger 150 as the transfer material charging means is used also for the second image carrier resistance/capacitance detection means, and when the following is controlled corresponding to the toner image receiving body resistance/capacitance detection signal from the paper charger 150: the transfer voltage value of the transfer roller 14*j* as the first transfer means by which the reverse side image on the photoreceptor drum 10 is transferred onto the toner image receiving body 14*a*; the transfer voltage value of the transfer roller 14*j* as the first transfer means by which the obverse side image on the photoreceptor drum 10 is transferred onto the obverse side of the recording sheet P; the transfer voltage value of the reverse side transfer device 14*g* as the second transfer means by which the reverse side image on the toner image receiving body 14*a* is transferred onto the reverse side of the recording sheet P; and the discharging voltage value of the paper separation AC discharger 14*h* as the transfer material separation means when the recording sheet P is separated from the toner image receiving body 14*a*.

The toner image receiving body resistance/capacitance detection by the paper 150 is conducted as follows: for example, as shown in FIGS. 13(A) through 13(O), the paper charger 150 is brought into contact with the toner image receiving body 14*a* to apply a voltage thereon when the recording sheet P as the transfer material does not pass on the toner image receiving body 14*a*, and the current value from the DC constant voltage power source E11 is detected, and the toner image receiving body resistance/capacitance detection signal is inputted into the control section.

When the image forming mode is selected by the operation section, not shown, and each image formation is conducted, the image formation mode, and the optimum current value according to changes of resistance/capacitance, which are previously obtained by experiments, and stored in the ROM, RAM as the memory means, are read from the ROM or RAM through the control section, corresponding to the selected image forming mode, or the toner image receiving body resistance/capacitance detection signal, and thereby, the correction for the following voltage values is conducted: the transfer voltage value of the transfer roller 14*j* by the DC constant voltage power source E21, the transfer voltage value of the reverse side transfer device 14*g* by the DC constant voltage power source E31, and the discharging voltage value of the paper separation AC discharger 14*h* by the AC constant voltage power source E41.

FIG. 16 is a block diagram when the transfer roller 14*j* as the first transfer means is used also for the second image carrier resistance/capacitance detection means, and when the following is controlled corresponding to the toner image receiving body resistance/capacitance detection signal from the transfer roller 14*j*: the transfer voltage value of the transfer roller 14*j* as the first transfer means by which the reverse side image on the photoreceptor drum 10 is transferred onto the toner image receiving body 14*a*; the transfer voltage value of the transfer roller 14*j* as the first transfer means by which the obverse side image on the photoreceptor drum 10 is transferred onto the obverse side of the recording sheet P; the transfer voltage value of the reverse side transfer device 14*g* as the second transfer means by which the reverse side image on the toner image receiving body 14*a* is transferred onto the reverse side of the recording sheet P; and the discharging voltage value of the paper separation AC discharger 14*h* as the transfer material separation means when the recording sheet P is separated from the toner image receiving body 14*a*.

The toner image receiving body resistance/capacitance detection by the transfer roller 14*j* is conducted when a voltage is applied onto the transfer roller 14*j* before the toner image on the photoreceptor drum 10 is transferred onto the toner image receiving body 14*a* or the recording sheet P, and the current value from the DC constant voltage power source E21 is detected, and the toner image receiving body resistance/capacitance detection signal is inputted into the control section.

When the image forming mode is selected by the operation section, not shown, and each image formation is conducted, the optimum current value is read in the same manner as described above, and thereby, the correction for the following voltage values is conducted: the transfer voltage value of the transfer roller 14*j* by the DC constant voltage power source E21, the transfer voltage value of the reverse side transfer device 14*g* by the DC constant voltage power source E31, and the discharging voltage value of the paper separation AC discharger 14*h* by the AC constant voltage power source E41.

FIG. 17 is a block diagram in the case where the following is controlled, corresponding to the toner image receiving body resistance/capacitance detection signal from a toner image receiving body cleaning blade 141, when voltage can be applied on the toner image receiving body cleaning blade 141, provided in the toner image receiving body cleaning apparatus 140 as the second image carrier cleaning means, and when the toner image receiving body cleaning blade 141 is used as the second image carrier resistance/capacitance detection means: the transfer voltage value of the transfer roller 14*j* as the first transfer means by which the reverse side image on the photoreceptor drum 10 is transferred onto the toner image receiving body 14*a*; the transfer voltage value of the transfer roller 14*j* as the first transfer means by which the obverse side image on the photoreceptor drum 10 is transferred onto the obverse side of the recording sheet P; the transfer voltage value of the reverse side transfer device 14*g* as the second transfer means by which the reverse side image on the toner image receiving body 14*a* is transferred onto the reverse side of the recording sheet P; and the discharging voltage value of the paper separation AC discharger 14*h* as the transfer material separation means when the recording sheet P is separated from the toner image receiving body 14*a*.

The toner image receiving body resistance/capacitance detection by the toner image receiving body cleaning blade 141 is carried out such that the toner image receiving body cleaning blade 141 is brought into contact with the toner image receiving body 14*a* before the toner image on the photoreceptor drum 10 is transferred onto the toner image receiving body 14*a* or recording sheet P, and the voltage is applied using the DC constant voltage power source E5 and the current value from the DC constant voltage power source E5 is detected. Then, the toner image receiving body resistance/capacitance detection signal is inputted into the control section.

When the image forming mode is selected by the operation section, not shown, and each image formation is conducted, the optimum current value is read in the same manner as described above, and thereby, the correction for the following voltage values is conducted: the transfer voltage value of the transfer roller 14*j* by the DC constant voltage power source E21, the transfer voltage value of the reverse side transfer device 14*g* by the DC constant voltage power source E31, and the discharging voltage value of the paper separation AC discharger 14*h* by the AC constant voltage power source E41.

Due to the foregoing, even when the resistance/capacitance of the second image carrier changes due to deterioration caused by repeated use of the second image carrier, or environmental conditions in the apparatus, transfer of the toner image, or separation of the transfer material can be finely conducted.

In the above example, process members such as the transfer material charging means or the similar device, are used also for the transfer material resistance/capacitance detection means or the second transfer means resistance/ capacitance detection means, however, the present invention is not limited to this, and of course, the system, in which the transfer material resistance/capacitance detection means or the second transfer means resistance/capacitance detection means having the same functions as the above description is independently provided, is included in the present invention.

According to the present invention, in both cases of the two-sided image formation and reverse side image formation, transfer of the toner image of the obverse side image is finely carried out.

According to the present invention, in both cases of the two-sided image formation and the reverse side image formation, transfer of the toner image of the reverse side image is finely carried out.

According to the present invention, in the case of two-sided image formation, transfer of either the toner image of the reverse side image or the toner image of the obverse side image on the first image carrier is finely carried out.

According to the present invention, in all cases of the two-sided image formation, the obverse side image formation, and the reverse side image formation, charging of transfer material is finely carried out.

According to the present invention, in all cases of the two-sided image formation, the obverse side image formation, and the reverse side image formation, separation of the transfer material is finely conducted.

According to the present invention, in the case of two-sided image formation, even when there is a difference in types of transfer material, or a change of the environmental condition, transfer of the toner image, charging of the transfer material, or separation of the transfer material is finely conducted.

According to the present invention, in the case of the obverse side image formation, even when there is a difference in types of transfer material, or a change of the environmental condition, transfer of the toner image, charging of the transfer material, or separation of the transfer material is finely conducted.

According to the present invention, in the case of the reverse side image formation, even when there is a difference in types of transfer material, or a change of the environmental condition, transfer of the toner image, charging of the transfer material, or separation of the transfer material is finely conducted.

According to the present invention, even when the resistance/capacitance of the transfer material changes due to the thickness or material of the transfer material, or environmental conditions in the apparatus, transfer of the toner image, charging of the transfer material, or separation of the transfer material is finely conducted.

According to the present invention, even when the resistance/capacitance of the second image carrier changes due to deterioration caused by repeated use of the second image carrier, or environmental conditions in the apparatus, transfer of the toner image, or separation of the transfer material can be finely conducted.

According to the present invention, even when there is a change or deterioration of the second image carrier, due to types of transfer material, a change of environmental condition, or repeated uses, transfer of the toner image, charging of the transfer material, and separation of the transfer material in the case of single-side image formation of the obverse side image, single-side image formation of the reverse side image, or two-sided image formation, are finely conducted by the second image carrier resistance/capacitance detection means.

What is claimed is:

1. An image forming apparatus comprising:

(a) a first image carrier;

(b) a toner image forming means for forming a toner image on the first image carrier;

(c) a second image carrier provided opposite to the first image carrier for carrying a transferred toner image;

(d) a first transfer means for transferring the toner image on the first image carrier onto the second image carrier, or for transferring the toner image on the first image carrier onto one side of a transfer material;

(e) a second transfer means for transferring the toner image carried on the second image carrier onto the other side of the transfer material;

(f) a fixing means for fixing at least one of the toner image on said one side of the transfer material on which the toner image has been transferred by the first transfer means and the toner image on said other side of the transfer material on which the toner image has been transferred by the second transfer means; and (g) a control means for controlling the toner image forming means, the first transfer means and the second transfer means, wherein the control means has a first image forming mode in which image formation is conducted only on said one side of the transfer material, a second image forming mode in which image formation is conducted only on said other side of the transfer material, and a third image forming mode in which image formation is conducted on both sides of the transfer material, and wherein the control means changes a transfer current or a transfer voltage of at least one of the first transfer means and the second transfer means, in accordance with the first, second or third image forming mode.

2. The image forming apparatus of claim 1 further comprising a transfer material charging means for charging the transfer material before the transfer material is fed to a transfer section, wherein the control means changes a charging current or a charging voltage of the transfer material charging means in accordance with the first, second or third image forming mode.

3. The image forming apparatus of claim 2, wherein an absolute value of the charging current or the charging voltage of the transfer material charging means when the image formation is conducted in the third image forming mode, is larger than that of the transfer material charging means when the image formation is conducted in the first image forming mode, and is equal to or smaller than that of the transfer material charging means when the image formation is conducted in the second image forming mode.

4. The image forming apparatus of claim 1 further comprising a transfer material separating means for separating the transfer material from the second image carrier after the toner image has been transferred onto the transfer material, wherein the control means changes a discharging current or a discharging voltage of the transfer material separating means in accordance with the first, second or third image forming mode.

5. The image forming apparatus of claim 4, wherein the discharging current or the discharging voltage of the transfer material separating means when the image formation is conducted in the second image forming mode, is larger than that of the transfer material separating means when the image formation is conducted in the first image forming mode, and is equal to or smaller than that of the transfer material separating means when the image formation is conducted in the third image forming mode.

6. The image forming apparatus of claim 1, wherein the control means changes the transfer current or the transfer voltage of the first transfer means in accordance with the first or third image forming mode.

7. The image forming apparatus of claim 6, wherein an absolute value of the transfer current or the transfer voltage of the first transfer means when the image formation is conducted in the third image forming mode, is larger than that of the first transfer means when the image formation is conducted in the first image forming mode.

8. The image forming apparatus of claim 1, wherein the control means changes the transfer current or the transfer voltage of the second transfer means in accordance with the second or third image forming mode.

9. The image forming apparatus of claim 8, wherein an absolute value of the transfer current or the transfer voltage of the second transfer means when the image formation is conducted in the third image forming mode, is larger than that of the second transfer means when the image formation is conducted in the second image forming mode.

10. The image forming apparatus of claim 1, wherein the control means changes the transfer current or the transfer voltage of the first transfer means in the third image forming mode, in accordance with an occasion either when the toner image on the first image carrier is transferred onto the second image carrier, or when the toner image on the first image carrier is transferred onto said one side of the transfer material.

11. The image forming apparatus of claim 10, wherein an absolute value of the transfer current or the transfer voltage of the first transfer means when the toner image on the first image carrier is transferred onto said one side of the transfer material, is larger than that of the first transfer means when the toner image on the first image carrier is transferred onto the second image carrier.

12. The image forming apparatus of claim 1, wherein in the third image forming mode, the control means changes concurrently at least two sets of values among the following sets of values according to a type of the transfer material or an environmental condition:

(1) a charging current or a charging voltage of a transfer material charging means for charging the transfer material before the transfer material is fed to a transfer section;

(2) the transfer current or the transfer voltage of the first transfer means for transferring the toner image on the first image carrier onto the second image carrier;

(3) the transfer current or the transfer voltage of the first transfer means for transferring the toner image on the first image carrier onto said one side of the transfer material;

(4) the transfer current or the transfer voltage of the second transfer means for transferring the toner image on the second image carrier onto said other side of the transfer material; and (5) a discharging current or a discharging voltage of a transfer material separating means for separating the transfer material from the second image carrier after the toner image has been transferred onto the transfer material.

13. The image forming apparatus of claim 12, wherein when the transfer current or the transfer voltage of the first transfer means for transferring the toner image on the first image carrier onto the second image carrier, is made large, the transfer current or the transfer voltage of the first transfer means for transferring the toner image on the first image carrier onto said one side of the transfer material, is also made large.

14. The image forming apparatus of claim 12, wherein when the transfer current or the transfer voltage of the first transfer means for transferring the toner image on the first image carrier onto the second image carrier, is made large, the transfer current or the transfer voltage of the second transfer means is also made large.

15. The image forming apparatus of claim 12, wherein when the transfer current or the transfer voltage of the first transfer means for transferring the toner image on the first image carrier onto said one side of the transfer material, is made large, the transfer current or the transfer voltage of the second transfer means is also made large.

16. The image forming apparatus of claim 12, wherein when an absolute value of the transfer current or the transfer voltage of the first transfer means for transferring the toner image on the first image carrier onto said one side of the transfer material, is made large, the discharging current or the discharging voltage of the transfer material separating means is also made large.

17. The image forming apparatus of claim 12, wherein when an absolute value of the transfer current or the transfer voltage of the second transfer means is made large, the discharging current or the discharging voltage of the transfer material separating means is also made large.

18. The image forming apparatus of claim 12, wherein when an absolute value of the charging current or the charging voltage of the transfer material charging means is made large, an absolute value of the transfer current or the transfer voltage of the first transfer means for transferring the toner image on the first image carrier onto said one side of the transfer material, is also made large.

19. The image forming apparatus of claim 12, wherein when an absolute value of the charging current or the charging voltage of the transfer material charging means is made large, an absolute value of the transfer current or the transfer voltage of the second transfer means is also made large.

20. The image forming apparatus of claim 12, wherein when an absolute value of the charging current or the charging voltage of the transfer material charging means is made large, the discharging current or the discharging voltage of the transfer material separating means is also made large.

21. The image forming apparatus of claim 1, wherein in the first image forming mode, the control means changes concurrently at least two sets of values among the following sets of values according to a type of the transfer material or an environmental condition:

(1) a charging current or a charging voltage of a transfer material charging means for charging the transfer material before the transfer material is fed to a transfer section;

(2) the transfer current or the transfer voltage of the first transfer means for transferring the toner image on the first image carrier onto said one side of the transfer material; and (3) a discharging current or a discharging voltage of a transfer material separating means for separating the transfer material from the second image carrier after the toner image has been transferred onto the transfer material.

22. The image forming apparatus of claim 21, wherein when an absolute value of the transfer current or the transfer voltage of the first transfer means is made large, the discharging current or the discharging voltage of the transfer material separating means is also made large.

23. The image forming apparatus of claim 21, wherein when an absolute value of the charging current or the charging voltage of the transfer material charging means is made large, an absolute value of the transfer current or the transfer voltage of the first transfer means is also made large.

24. The image forming apparatus of claim 21, wherein when an absolute value of the charging current or the charging voltage of the transfer material charging means is made large, the discharging current or the discharging voltage of the transfer material separating means is also made large.

25. The image forming apparatus of claim 1, wherein in the second image forming mode, the control means changes concurrently at least two sets of values among the following sets of values according to a type of the transfer material or an environmental condition:

(1) a charging current or a charging voltage of a transfer material charging means for charging the transfer material before the transfer material is fed to a transfer section;

(2) the transfer current or the transfer voltage of the first transfer means for transferring the toner image on the first image carrier onto the second image carrier;

(3) the transfer current or the transfer voltage of the second transfer means for transferring the toner image on the second image carrier onto said other side of the transfer material; and (4) a discharging current or a discharging voltage of a transfer material separating means for separating the transfer material from the second image carrier after the toner image has been transferred onto the transfer material.

26. The image forming apparatus of claim 25, wherein when the transfer current or the transfer voltage of the first transfer means is made large, the transfer current or the transfer voltage of the second transfer means is also made large.

27. The image forming apparatus of claim 25, wherein when an absolute value of the transfer current or the transfer voltage of the second transfer means is made large, the discharging current or the discharging voltage of the transfer material separating means is also made large.

28. The image forming apparatus of claim 25, wherein when an absolute value of the charging current or the charging voltage of the transfer material charging means is made large, an absolute value of the transfer current or the transfer voltage of the second transfer means is also made large.

29. The image forming apparatus of claim 25, wherein when an absolute value of the charging current or the charging voltage of the transfer material charging means is made large, the discharging current or the discharging voltage of the transfer material separating means is also made large.

30. The image forming apparatus of claim 1 further comprising a resistance and capacitance detecting means for detecting at least one of a resistance and a capacitance of the transfer material by detecting a current when a voltage is applied to the transfer material or an applied voltage when a current is applied to the transfer material, wherein the control means changes at least one set of values among the following sets of values in accordance with a detected result of said resistance and capacitance detecting means:

(1) a charging current or a charging voltage of a transfer material charging means for charging the transfer material before the transfer material is fed to a transfer section;

(2) the transfer current or the transfer voltage of the first transfer means for transferring the toner image on the first image carrier onto said one side of the transfer material;

(3) the transfer current or the transfer voltage of the second transfer means for transferring the toner image on the second image carrier onto said other side of the transfer material; and (4) a discharging current or a discharging voltage of a transfer material separating means for separating the transfer material from the second image carrier after the toner image has been transferred onto the transfer material.

31. The image forming apparatus of claim 30, wherein the transfer material charging means is used as the resistance and capacitance detecting means.

32. The image forming apparatus of claim 1 further comprising:

a resistance and capacitance detecting means for detecting at least one of a resistance and a capacitance of the transfer material by detecting a current when a voltage is applied to the transfer material or an applied voltage when a current is applied to the transfer material; and a transfer material width detecting means for detecting a width of the transfer material in a direction perpendicular to a feeding of the transfer material, wherein the control means changes at least one set of values among the following sets of values in accordance with a detected result of said resistance and capacitance detecting means and a detected result of the transfer material width detecting means:

(1) a charging current or a charging voltage of a transfer material charging means for charging the transfer material before the transfer material is fed to a transfer section;

(2) the transfer current or the transfer voltage of the first transfer means for transferring the toner image on the first image carrier onto said one side of the transfer material;

(3) the transfer current or the transfer voltage of the second transfer means for transferring the toner image on the second image carrier onto said other side of the transfer material; and (4) a discharging current or a discharging voltage of a transfer material separating means for separating the transfer material from the second image carrier after the toner image has been transferred onto the transfer material.

33. The image forming apparatus of claim 32, wherein the transfer material charging means is used as the resistance and capacitance detecting means.

34. The image forming apparatus of claim 1 further comprising a detecting means for detecting at least one of a resistance and a capacitance of the second image carrier by detecting a current when a voltage is applied to the second image carrier or an applied voltage when a current is applied to the second image carrier, wherein the control means changes at least one set of values among the following sets of values in accordance with a detected result of said detecting means:

(1) the transfer current or the transfer voltage of the first transfer means for transferring the toner image on the first image carrier onto the second image carrier;

(2) the transfer current or the transfer voltage of the first transfer means for transferring the toner image on the first image carrier onto said one side of the transfer material;

(3) the transfer current or the transfer voltage of the second transfer means for transferring the toner image on the second image carrier onto said other side of the transfer material; and (4) a discharging current or a discharging voltage of a transfer material separating means for separating the transfer material from the second image carrier after the toner image has been transferred onto the transfer material.

35. The image forming apparatus of claim 34, wherein a transfer material charging means for charging the transfer material in a feeding position where the transfer material is fed to the second image carrier, is used as the detecting means.

36. The image forming apparatus of claim 34, wherein the first transfer means comprises a roller member which can be in contact with the second image carrier and to which a voltage can be applied, and wherein the first transfer means is used as the detecting means.

37. The image forming apparatus of claim 34 further comprising a cleaning means being in contact with the second image carrier to remove a residual toner on the second image carrier, to which a voltage is applied, wherein the cleaning means is used as the detecting means.

38. The image forming apparatus of claim 1 further comprising:

a transfer material charging means for charging the transfer material before the transfer material is fed to a transfer section; and a transfer material separating means for separating the transfer material from the second image carrier after the toner image has been transferred.

* * * * *